US009779668B2

(12) United States Patent
Park et al.

(10) Patent No.: US 9,779,668 B2
(45) Date of Patent: Oct. 3, 2017

(54) ORGANIC LIGHT EMITTING DISPLAY DEVICE

(71) Applicant: SAMSUNG DISPLAY CO., LTD., Yongin, Gyeonggi-Do (KR)

(72) Inventors: Kyong-Tae Park, Yongin (KR); Tae-Gon Kim, Yongin (KR); Dong-Yoon So, Yongin (KR); Sung-Ho Cho, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 143 days.

(21) Appl. No.: 14/733,790

(22) Filed: Jun. 8, 2015

(65) Prior Publication Data

US 2016/0104431 A1 Apr. 14, 2016

(30) Foreign Application Priority Data

Oct. 10, 2014 (KR) ..... 10-2014-0136616

(51) Int. Cl.

*G09G 3/32* (2016.01)
*G09G 3/3291* (2016.01)
*G09G 3/3233* (2016.01)

(52) U.S. Cl.

CPC ..... *G09G 3/3291* (2013.01); *G09G 3/3233* (2013.01); *G09G 2300/0413* (2013.01); *G09G 2300/0819* (2013.01); *G09G 2300/0842* (2013.01); *G09G 2300/0861* (2013.01); *G09G 2320/0223* (2013.01); *G09G 2320/0233* (2013.01); *G09G 2330/08* (2013.01); *G09G 2330/10* (2013.01)

(58) Field of Classification Search

CPC ..... H01L 27/3213; H01L 27/3223; G09G 2330/10; G09G 2330/12; G09G 3/006; G09G 3/3241; G09G 3/3283; G09G 3/3233; G09G 2300/0408; G09G 2300/0417; G09G 2320/0233; G09G 2320/0819; G09G 2330/08

See application file for complete search history.

(56) References Cited

U.S. PATENT DOCUMENTS

2010/0277401 A1* 11/2010 Takahara ..... G09G 3/006 345/76
2014/0183481 A1* 7/2014 Lee ..... H01L 27/3213 257/40
2014/0347401 A1* 11/2014 Hwang ..... G09G 3/3233 345/690
2016/0078810 A1 3/2016 Park et al.
2016/0104421 A1 4/2016 Park et al.

FOREIGN PATENT DOCUMENTS

KR 10-0666639 B1 1/2007
KR 10-2008-0000222 A 1/2008

* cited by examiner

*Primary Examiner* — Benjamin C Lee
*Assistant Examiner* — Robert Michaud
(74) *Attorney, Agent, or Firm* — Lewis Roca Rothgerber Christie LLP

(57) ABSTRACT

An organic light emitting display device including data lines, an auxiliary data line, and a compensation data line, a display area including display pixels connected to the data lines, a nondisplay area including auxiliary pixels connected to the auxiliary data line, and compensation pixels connected to the compensation data line, and auxiliary lines connected to the auxiliary pixels and the compensation pixels.

13 Claims, 12 Drawing Sheets

ORGANIC LIGHT EMITTING DISPLAY DEVICE

CROSS-REFERENCE TO RELATED APPLICATION

This application claims priority to and the benefit of Korean Patent Application No. 10-2014-0136616, filed on Oct. 10, 2014, in the Korean Intellectual Property Office, the entire content of which is incorporated herein by reference.

BACKGROUND

1. Field

Aspects of embodiments of the present disclosure relate to an organic light emitting display device.

2. Description of Related Art

As information-oriented societies develop, there is an increasing need for various types of display devices for displaying images. And recently, various flat panel display devices such as liquid crystal displays, plasma display panels, and organic light emitting display devices are being used.

The organic light emitting display device has a display panel including data lines, scan lines, and a plurality of pixels arranged in a matrix format at crossing areas of the data lines and the scan lines; a data driver configured to provide data voltages to the data lines; and a scan driver configured to provide scan signals to the scan lines. Furthermore, the display panel further includes a power supply for providing a plurality of power voltages. Each pixel emits light of a brightness determined by an amount of current flowing from a first power voltage of the plurality of power voltages to an organic light emitting diode according to a data voltage provided through a data line data line when a scan signal is supplied using a plurality of transistors.

Additionally, during a process of manufacturing an organic light emitting display device, a defect may occur in the transistors of the pixels, reducing (e.g., deteriorating) the yield of the organic light emitting display device. In order to improve this, a method was proposed for repairing a defective pixel by connecting the defective pixel with one of the auxiliary pixels (see Korean Patent Registration 10-0666639).

According to the aforementioned repair method, the transistors of defective pixels are disconnected from the organic light emitting diode, and the transistors of auxiliary pixels are connected with anode electrodes of the organic light emitting diode of defective pixels using an auxiliary line. As a result, it becomes possible to drive the transistors of the auxiliary pixels and make the organic light emitting diode of the defective pixels to emit light.

However, parasitic capacitances may be formed between the auxiliary line and the anode electrodes of the organic light emitting diodes of the pixels, and a fringe capacitance may be formed between the auxiliary line and an adjacent scan line. In this case, the voltage of the auxiliary line may change due to the parasitic capacitances and fringe capacitance, thereby causing the organic light emitting diode of the repaired pixel to emit light erroneously.

SUMMARY

Aspects of one or more embodiments of the present disclosure are directed to an organic light emitting display device capable of preventing or substantially preventing an organic light emitting diode of a repaired pixel from emitting light erroneously.

According to an embodiment, there is provided an organic light emitting display device including: data lines, an auxiliary data line, and a compensation data line; a display area including display pixels connected to the data lines; a nondisplay area including auxiliary pixels connected to the auxiliary data line, and compensation pixels connected to the compensation data line; and auxiliary lines connected to the auxiliary pixels and the compensation pixels.

In an embodiment, the organic light emitting display device further includes: scan lines and light emitting control lines that cross the data lines, the auxiliary data fine, and the compensation data line; a data driver configured to supply data voltages to the data lines, to supply auxiliary data voltages to the auxiliary data line, and to supply compensation data voltages to the compensation data line; and a scan driver configured to supply scan signals to the scan lines, and to supply light emitting control signals to the light emitting control lines.

In an embodiment, an auxiliary pixel and a compensation pixel adjacent to each other in a scan line direction are connected to a same scan line and light emitting control line.

In an embodiment, the data driver is configured to synchronize an auxiliary data voltage and a compensation data voltage supplied to the auxiliary pixel and the compensation pixel adjacent to each other, and to supply the synchronized auxiliary data voltage and the compensation data voltage.

In an embodiment, the auxiliary pixels and the compensation pixels are arranged alternately by turns in a data line direction.

In an embodiment, the auxiliary pixels are connected to even scan lines, and the compensation pixels are connected to odd scan lines.

In an embodiment, the data driver is configured to supply a compensation data voltage to the compensation pixel connected to a kth scan line (k being a positive integer) in synchronization with data voltages supplied to the display pixels connected to the kth scan line, and to supply an auxiliary data voltage to the auxiliary pixel connected to the (k+1)th scan line in synchronization with data voltages supplied to the display pixels connected to the (k+1)th scan line.

In an embodiment, the auxiliary pixels are connected to odd scan lines, and the compensation pixels are connected to even scan lines.

In an embodiment, the data driver is configured to supply an auxiliary data voltage to the auxiliary pixel connected to a kth scan line (k being a positive integer) in synchronization with data voltages supplied to the display pixels connected to the kth scan line, and to supply a compensation data voltage to the compensation pixel connected to the (k+1)th scan line in synchronization with data voltages supplied to the display pixels connected to the (k+1)th scan line.

In an embodiment, the data driver includes: an auxiliary data computing unit configured to compute digital video data being supplied to a repaired pixel of the display pixels as auxiliary data; a memory configured to store the auxiliary data, and to update the auxiliary data to initialized data at every period; and an auxiliary data voltage converter configured to receive the auxiliary data or initialized data from the memory, to convert the auxiliary data or initialized data into an auxiliary data voltage, and to supply the converted auxiliary data voltage to the auxiliary data line.

In an embodiment, the data driver includes: a gray value computing unit configured to compute red gray values supplied to red pixels, green gray values supplied to green pixels, and blue gray values supplied to blue pixels, the red pixels, the green pixels, and the blue pixels connected to a same scan line as a repaired pixel of the display pixels; a coupling voltage computing unit configured to compute a coupling voltage corresponding to a voltage at which the auxiliary line is affected by the red pixels, green pixels, and blue pixels connected to a same scan line as the repaired pixel using the red gray values, green gray values, and blue gray values; a compensation voltage computing unit configured to compute a compensation voltage as a difference between a maximum coupling voltage and the coupling voltage; and a compensation data computing unit configured to compute compensation data according to the compensation voltage.

In an embodiment, the data driver further includes a compensation data voltage converter configured to convert the compensation data into a compensation data voltage and to supply the converted compensation data voltage to the compensation data line.

In an embodiment, the coupling voltage computing unit is further configured to compute red coupling voltages corresponding to voltages at which the auxiliary lines are affected by the red pixels using the red gray values, to compute green coupling voltages corresponding to voltages at which the auxiliary lines are affected by the green pixels using the green gray values, to compute blue coupling voltages corresponding to voltages affected by the auxiliary lines by the blue pixels using the blue gray values, and to add up the red coupling voltages, the green coupling voltages, and the blue coupling voltages to compute the coupling voltage.

An embodiment of the present disclosure may compute a coupling voltage generated by parasitic capacitances between a repaired pixel and display pixels connected to a same scan line, and compute a compensation gray value using the coupling voltage, and output the compensation data voltage to the compensation pixel using the compensation gray value. Thus, because it is possible to provide a compensation current to the auxiliary line using the compensation pixel, it is possible to compensate the change of potential of the auxiliary line by the coupling voltage generated by the parasitic capacitances formed between the display pixels connected to a same scan line as that of the repaired pixel.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element or layer is referred to as being "between" two elements or two layers, respectively, it can be the only element or layer between the two elements or two layers, or one or more intervening elements or layers may also be present. Like reference numerals refer to like elements throughout.

DETAILED DESCRIPTION

Figure 1:
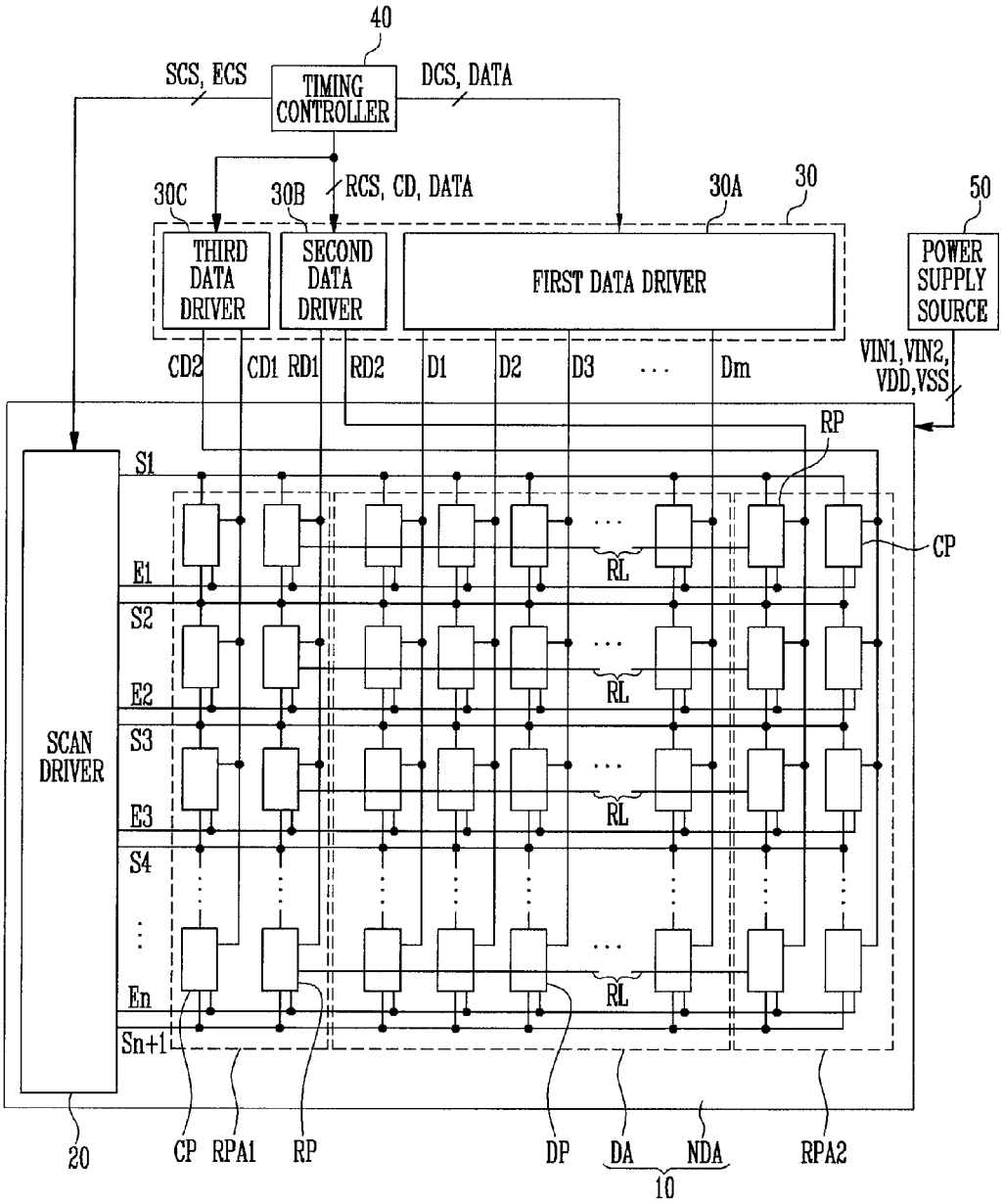
FIG. 1 is a block diagram illustrating an organic light emitting display device according to an embodiment of the present disclosure.

Hereinafter, embodiments will be described in greater detail with reference to the accompanying drawings. Embodiments are described herein with reference to cross-sectional illustrations that are schematic illustrations of embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but may include deviations in shapes that result, for example, from manufacturing. In the drawings, lengths and sizes of layers and regions may be exaggerated for clarity. Like reference numerals in the drawings denote like elements.

Terms such as 'first' and 'second' may be used to describe various components, but they should not limit the various components. Those terms are only used for the purpose of differentiating a component from other components. For example, a first component may be referred to as a second component, and a second component may be referred to as a first component and so forth without departing from the spirit and scope of the present disclosure. Furthermore, 'and/or' may include any one of or a combination of the components mentioned.

In addition, it will also be understood that when a layer is referred to as being "between" two layers, it can be the only layer between the two layers, or one or more intervening layers may also be present.

As used herein, the term "and/or" includes any and all combinations of one or more of the associated listed items. Further, the use of "may" when describing embodiments of the inventive concept refers to "one or more embodiments of the inventive concept."

Also, the term "exemplary" is intended to refer to an example or illustration.

As used herein, the term "substantially," "about," and similar terms are used as terms of approximation and not as terms of degree, and are intended to account for the inherent deviations in measured or calculated values that would be recognized by those of ordinary skill in the art.

Furthermore, a singular form may include a plural from as long as it is not specifically mentioned in a sentence. Furthermore, "include/comprise" or "including/comprising" used in the specification represents that one or more components, steps, operations, and elements exist or are added.

Furthermore, unless defined otherwise, all the terms used in this specification including technical and scientific terms have the same meanings as would be generally understood by those skilled in the related art. The terms defined in generally used dictionaries should be construed as having the same meanings as would be construed in the context of the related art, and, unless clearly defined otherwise in this specification, should not be construed as having idealistic or overly formal meanings.

It is also noted that in this specification, "connected/coupled" refers to one component not only directly coupled to another component but also indirectly coupling another component through an intermediate component. That is, "directly connected/directly coupled" refers to one component directly coupling another component without an intermediate component.

FIG. 1 is a block diagram illustrating an organic light emitting display device according to an embodiment of the present disclosure. Referring to FIG. 1, the organic light emitting display device according to this embodiment of the present disclosure includes a display panel 10, a scan driver 20, a data driver 30, a timing controller 40, and a power supply source 50.

Figure 2:
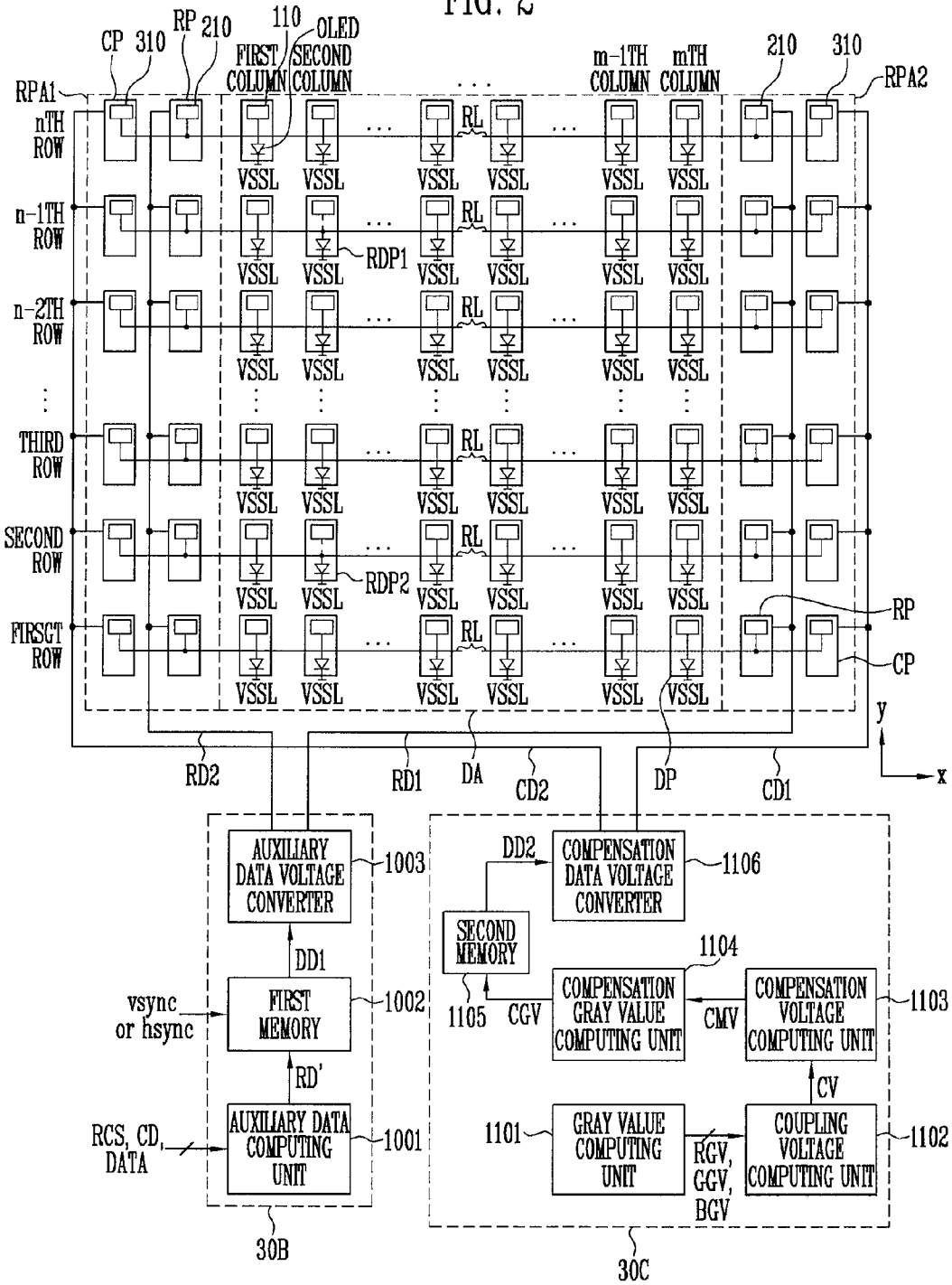
FIG. 2 is a block diagram illustrating in further detail display pixels, auxiliary pixels, compensation pixels, auxiliary lines, auxiliary data lines, auxiliary data lines, a second data driver, and a third data driver according to an embodiment of the present disclosure.

On the display panel 10, data lines (D1 ~Dm, m being a positive integer greater than 1), auxiliary data lines (RD1 and RD2), compensation data lines (CD1 and CD2), scan lines (S1~Sn+1, n being a positive integer greater than 1), and light emitting control lines (E1~En) are formed. The data lines (D1~Dm), auxiliary data lines (RD1 and RD2), and compensation data lines (CD1 and CD2) may be formed substantially in parallel to (e.g., in parallel to) one another. The auxiliary data lines (RD1 and RD2) and compensation data lines (CD1 and CD2) may be formed on an exterior of both sides of the data lines (D1~Dm). For example, as illustrated in FIGS. 1 and 2, a first auxiliary data line (RD1) and a first compensation data line (CD1) may be formed on a left exterior of the data lines (D1~Dm), and a second auxiliary data line (RD2) and a second compensation data line (CD2) may be formed on a right exterior of the data lines (D1~Dm). The data lines (D1~Dm) and the scan lines (S1~Sn+1) may be formed to cross (e.g., intersect) each other. Likewise, the auxiliary data lines (RD1 and RD2) and scan lines (S1~Sn+1), and the compensation data lines (CD1 and CD2) and scan lines(S1~Sn+1) may be formed to cross each other as well. The scan lines (S1~Sn+1) and light emitting control lines (E1~En) may be formed substantially parallel to (e.g., parallel to) each other.

The display panel 10 includes a display area (DA) where display pixels (DP) that display images are formed and a nondisplay area (NDA) that corresponds to an area beside (e.g., adjacent to the side of) the display area (DA). The nondisplay area (NDA) may include first and second auxiliary pixel areas (RPA1, RPA2) where auxiliary pixels (RP) for repairing the display pixels (DP) are formed, and compensation pixels (CP) are formed for compensating a change of potential of an auxiliary line (RL) resulting from a coupling voltage generated by the parasitic capacitances formed between the auxiliary line (RL) and display pixels (DP). On the first auxiliary pixel area (RPA1), auxiliary pixels (RP) may be connected to the first auxiliary data lines (RD1) and compensation pixels (CP) may be connected to the first compensation data lines (CD1), and on the second auxiliary pixel area (RPA2), auxiliary pixels (RP) may be connected to the second auxiliary data line (RD2) and compensation pixels (CP) may be connected to the second compensation data line (CD2).

On the display area (DA), display pixels (DP) may be arranged in a matrix format at crossing areas of the data lines (D1~Dm) and scan lines (S1~Sn+1). Each of the display pixels (DP) may be connected to a data line, two scan lines, and a light emitting control line. Each of the display pixels (DP) supplies a driving current to the organic light emitting diode according to a data voltage from a data line, thereby emitting light. The display pixels (DP) may include a red pixel, green pixel, and blue pixel.

On each of the auxiliary pixel areas (RPA1 and RPA2), auxiliary pixels (RP) may be arranged on crossing areas of the auxiliary data lines (RD1/RD2) and scan lines (S1~Sn+1). The auxiliary pixels (RP) are pixels for repairing the display pixels (DP) where a defect has occurred during a process of manufacturing the display panel 10. Each of the auxiliary pixel (RP) may be connected to an auxiliary data line, two scan lines, a light emitting control line, and an auxiliary line (RL). The auxiliary line (RL) is connected to the auxiliary pixel (RP), and is extended from the auxiliary pixel (RP) to the display area (DA) and to cross (e.g., intersect) the display pixels (DP).

When a defect occurs in a display pixel (DP), the display pixel (DP) where the defect occurred is connected to the auxiliary line (RL) through a laser short-circuit process. Therefore, the auxiliary pixel (RP) is connected to the display pixel (DP) where the defect occurred through the auxiliary line (RL), and the auxiliary pixel (RP) may repair the display pixel (DP) where the defect occurred using the auxiliary pixel (RP). Each of the auxiliary pixels (RP) supplies a driving current to the organic light emitting diode of the display pixel (DP) where the defect occurred according to the auxiliary data voltage from the auxiliary data line. Due to this, the display pixel (DP) having the defect emits light. Hereinafter, for convenience of explanation, a display pixel (DP) where a defect occurred and then repaired will be called a repaired pixel.

Furthermore, on each of the auxiliary pixel areas (RPA1, RPA2), compensation pixels (CP) may be arranged on crossing areas of the compensation data lines (CD1/CD2)

and scan lines (S1~Sn+1). The compensation pixels (CP) are pixels for compensating a change of potential of the auxiliary line (RL) by a coupling voltage generated by parasitic capacitances formed between the auxiliary line (RL) and display pixels (DP). Each of the compensation pixels (CP) may be connected to a compensation data line, two scan lines, a light emitting control line, and an auxiliary line (RL). Each of the compensation pixels (CP) supplies a compensation current to the auxiliary line (RL) according to a compensation data voltage from the auxiliary data line, thereby compensating a change of potential of the auxiliary line (RL) by the coupling voltage generated by parasitic capacitances formed between the auxiliary line (RL) and display pixels (DP).

Furthermore, on the display panel 10, a plurality of power voltage lines may be formed to supply a plurality of power voltages to the display pixels (DP), auxiliary pixels (RP), and compensation pixels (CP). It is to be noted that for convenience of explanation, FIG. 1 does not illustrate a plurality of power voltage lines.

The scan driver 20 may include a scan signal output unit for outputting scan signals to the scan lines (S0~Sn), and a light emitting control signal output unit for outputting light emitting control signals to the light emitting control fines (E1~En). The scan signal output unit receives a scan timing control signal (SCS) from the timing controller 50, and outputs scan signals to the scan lines (S1~Sn+1) according to the scan timing control signal (SCS). The light emitting control signal output unit receives the light emitting timing control signal (ECS) from the timing controller 50, and outputs the light emitting control signals to the light emitting control lines (E1~En) according to the light emitting timing control signal (ECS).

The scan signal output unit and light emitting control signal output unit may be formed directly on the nondisplay area (NDA) of the display panel 10 as in an amorphous silicon gate (ASG) method or gate driver in panel (ASG) method. In this case, each of the scan signal output unit and the light emitting control signal output unit may include scan stages that are dependently connected. The scan stages may sequentially output the scan signals to the scan lines (S1~Sn+1), and the light emitting stages may sequentially output the light emitting control signals to the light emitting control lines (E1~En).

The data driver 30 includes first to third data drivers (30A, 30B, 30C).

The first data driver (30A) includes at least one source drive IC. The source driver IC receives digital video data (DATA) and source timing control signals (DCS) from the timing controller (50). The source drive IC converts the digital video data (DATA) into data voltages in response to the source timing control signal (DCS). The source drive IC is synchronized with each of the scan signals and supplies the data voltages to the data lines (D1~Dm). Accordingly, the source drive IC supplies the data voltages to the display pixels (DP) where the scan signals are supplied.

The second data driver (30B) receives a repair control signal (RCS), digital video data (DATA) and coordinate data (CD) of the repaired pixel. The second data driver (30B) generates auxiliary data voltages using the repair control signal (RCS), digital video data (DATA), and coordinate data (CD) of the repaired pixel. The second data driver (30B) supplies the auxiliary data voltages to the auxiliary data lines (RD1, RD2). Supplying auxiliary data voltages by the second data driver (30B) will be explained in more detail hereinafter with reference to FIG. 4.

The second data driver (30B) supplies to the auxiliary pixel connected to the repaired pixel an auxiliary data voltage that is the same or substantially the same as the data voltage to be supplied to the repaired pixel, to repair the repaired pixel. Timing of supplying the auxiliary data voltage by the second data driver (30B) will be explained hereinafter with reference to FIGS. 3, 12, and 14.

The third data driver (30C) receives the repair control signal (RCS), the digital video data (DATA), and the coordinate data (CD) of the repaired pixel from the timing controller 50. The third data driver (30C) generates compensation data voltages using the repair control signal (RCS), digital video data (DATA), and coordinate data (CD) of the repaired pixel. The third data driver (30C) supplies the compensation data voltages to the compensation data lines (CD1 and CD2). The third data driver (30C) supplies the compensation data voltages to the compensation data lines (CD1 and CD2). Supplying the compensation data voltages by the third data driver (30C) will be explained in more detail hereinafter with reference to FIGS. 5 to 9, and timing of supplying the compensation data voltages by the third data driver (30C) will be explained in more detail hereinafter with reference to FIGS. 3, 12, and 14.

The timing controller (50) receives digital video data (DATA) and timing signals from outside. The timing controller (50) generates timing control signals for controlling the scan driver (30) and the first data driver (30) based on the timing signals. The timing control signals include the scan timing control signal (SCS) for controlling the operating timing of the scan signal output unit of the scan driver (20), light emitting timing control signal (ECS) for controlling the operating timing of the light emitting control signal output unit of the scan driver (20), and the data timing control signal (DCS) for controlling the operating timing of the first data driver (30). The timing controller (50) outputs the scan timing control signal (SCS) and light emitting timing control signal (ECS) to the scan driver (20), and outputs the data timing control signal (DCS) and digital video data (DATA) to the first data driver (30).

Furthermore, the timing controller (50) generates a repair control signal (RCS), and a coordinate data (CD) of the repaired pixel. The repair control signal (RCS) is a signal that indicates whether or not there is a repaired pixel. For example, when there is a repaired pixel, the repair control signal (RCS) may be generated in a first logic level voltage, and when there is no repaired pixel, the repair control signal (RCS) may be generated in a second logic level voltage. The coordinate data (CD) of the repaired pixel is a signal that indicates a coordinate value of the repaired pixel. The coordinate data (CD) of the repaired pixel may be stored in a memory of the timing controller (50). The timing controller (50) outputs the repair control signal (RCS), coordinate data (CD) of the repaired pixel, and digital video data (DATA) to each of the second and third data drivers (30B, 30C).

The power supply source (60) may supply a plurality of power voltages to a plurality of power voltage lines. The power supply source (60) may supply first to fourth power voltage lines (VIN1, VIN2, VDD, and VSS) to first to fourth power voltage lines as illustrated in FIG. 1. In FIG. 1, the first to fourth power voltage lines may not be provided for convenience of explanation. Furthermore, the power supply source (60) may supply a gate-off voltage and gate-on voltage to the scan driver (20).

FIG. 2 is a block diagram illustrating display pixels, auxiliary pixels, compensation pixels, auxiliary data lines, compensation data lines, a second data driver, and third data driver according to an embodiment of the present disclosure. For convenience of explanation, FIG. 2 illustrates only the display pixels (DP), auxiliary pixels (RP), compensation pixels (CP), auxiliary lines (RL), auxiliary data lines (RD1 and RD2), compensation data lines (CD1 and CD2), a second data driver (30B), and a third data driver (30C) of the display panel (10).

Referring to FIG. 2, each of the display pixels (DP) includes a display pixel driver (110) and an organic light emitting diode (OLED). The organic light emitting diode (OLED) emits light in a brightness (e.g., a predetermined brightness) according to a driving current of the display pixel driver (110). An anode electrode of the organic light emitting diode (OLED) may be connected to the display pixel driver (110), and a cathode electrode of the organic light emitting diode (OLED) may be connected to a fourth power voltage line (VSSL) to which the fourth power voltage is supplied. The fourth power voltage may be a low potential power voltage.

Each of the auxiliary pixels (RP) includes an auxiliary pixel driver (210). The auxiliary pixel driver (210) is connected to an auxiliary line (RL). The auxiliary pixel driver (210) supplies a driving current to the auxiliary line (RL). Each of the compensation pixels (CP) includes a compensation pixel driver (310). The compensation driver (310) is connected to the auxiliary line (RL). The compensation pixel driver (310) supplies a compensation current to the auxiliary line (RL). The display pixel driver (110), auxiliary pixel driver (210), and compensation pixel driver (310) are explained hereinabove with reference to FIG. 10.

Figure 12:
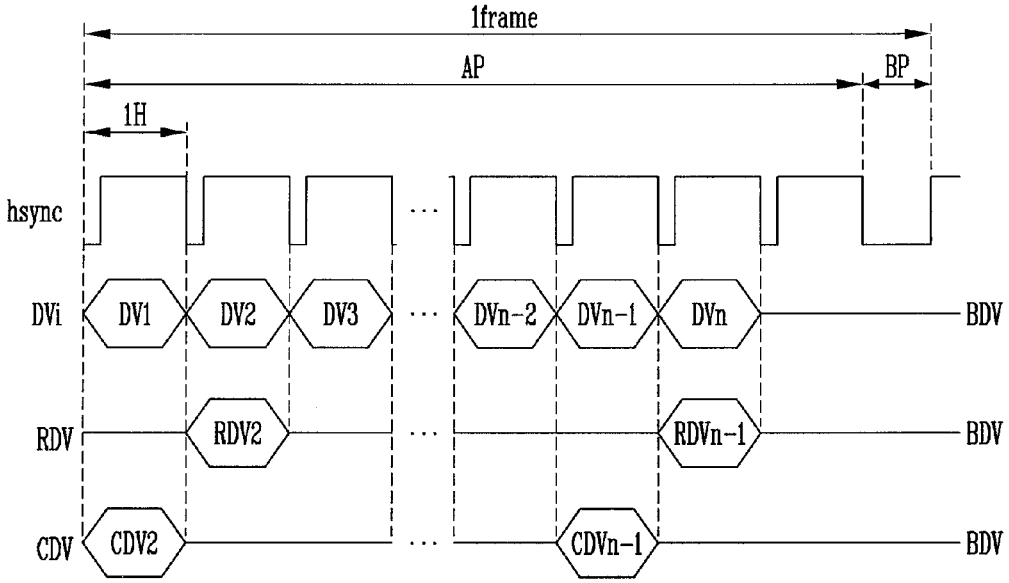
FIG. 12 is an exemplary timing diagram illustrating data voltages being output from a first data driver of FIG. 11, auxiliary data voltages being output from a second data driver, and compensation data voltages being output from a third data driver.

FIG. 12 exemplifies that the auxiliary pixels (RP) and compensation pixels (CP) are formed on an exterior of the display pixels (DP), and that the compensation pixels (CP) are formed on an exterior of the auxiliary pixels (RP), but there is no limitation thereto. That is, the auxiliary pixels (RP) may be formed on an exterior of the compensation pixels (CP).

An auxiliary pixel (RP) and a compensation pixel (CP) adjacent to each other in a scan direction (x axis direction) are connected to a same scan line and a same light emitting control line. Thus, an auxiliary data voltage and compensation data voltage being supplied to each of the auxiliary pixel (RP) and compensation pixel (CP) that are connected to the same scan line and the same light emitting control line are synchronized to each other. Detailed explanation of the aforementioned will be explained hereinafter with reference to FIG. 3.

The auxiliary line (RL) is connected to the auxiliary pixel (RP) and the compensation pixel (CP), and is extended from the auxiliary pixel (RP) to the display area (DA) and to cross (e.g., to intersect) the display pixels (DP). For example, as illustrated in FIG. 2, the auxiliary line (RL) may be connected to an auxiliary pixel (RP) of a pth (p being a positive integer satisfying $1 \leq p \leq n$) line, and to cross the display pixels (DP) of the pth line. For example, as illustrated in FIG. 2, the auxiliary line (RL) may be formed to cross anode electrodes of the organic light emitting diode (OLED) of the display pixels (DP).

For example, as illustrated in FIG. 2, the auxiliary line (RL) may be formed to cross anode electrodes of the organic light emitting diode (OLED) of the display pixels (DP).

The auxiliary line (RL) may be connected to one of the display pixels (DP) in the display area (DA). Herein, the display pixel (DP) to be connected to the auxiliary line (RL) is a defective pixel that should be repaired. In FIG. 2, the display pixel (DP) to be connected to the auxiliary line (RL) is defined as a repaired pixel (RDP1/RDP2). For example, the auxiliary line (RL) may be connected to an anode electrode of the organic light emitting diode (OLED) of the repaired pixel (RDP1/RDP2). Herein, the display pixel driver (110) of the repaired pixel (RDP1/RDP2) and the organic light emitting diode (OLED) are disconnected from each other.

The auxiliary pixels (RP) of the first auxiliary pixel area (RP1) are connected to the first auxiliary data line (RDI), and the compensation pixels (CP) are connected to the first compensation data line (CD1). The auxiliary pixels (RP) of the second auxiliary pixel area (RP2) are connected to the second auxiliary data line (RD2), and the compensation pixels (CP) are connected to the first compensation data lines (CD2). The display pixels (DP) of the display area (DA) are connected to the data lines (D1~Dm), but the data lines (D1~Dm) are omitted in FIG. 2 for convenience of explanation.

The second data driver (30B) includes an auxiliary data computing unit (1001), a first memory (1002), and an auxiliary data voltage converter (1003). The second data driver (30B) will be explained in more detail hereinafter with reference to FIGS. 2 and 4.

The third data driver (30C) includes a gray value computing unit (1101), a coupling voltage computing unit (1102), a compensation voltage computing unit (1103), a compensation data computing unit (1104), a second memory (1105), and a compensation data voltage converter (1106). The third data driver (30C) will be explained in more detail hereinafter with reference to FIGS. 2, and 5 to 9.

Figure 3:
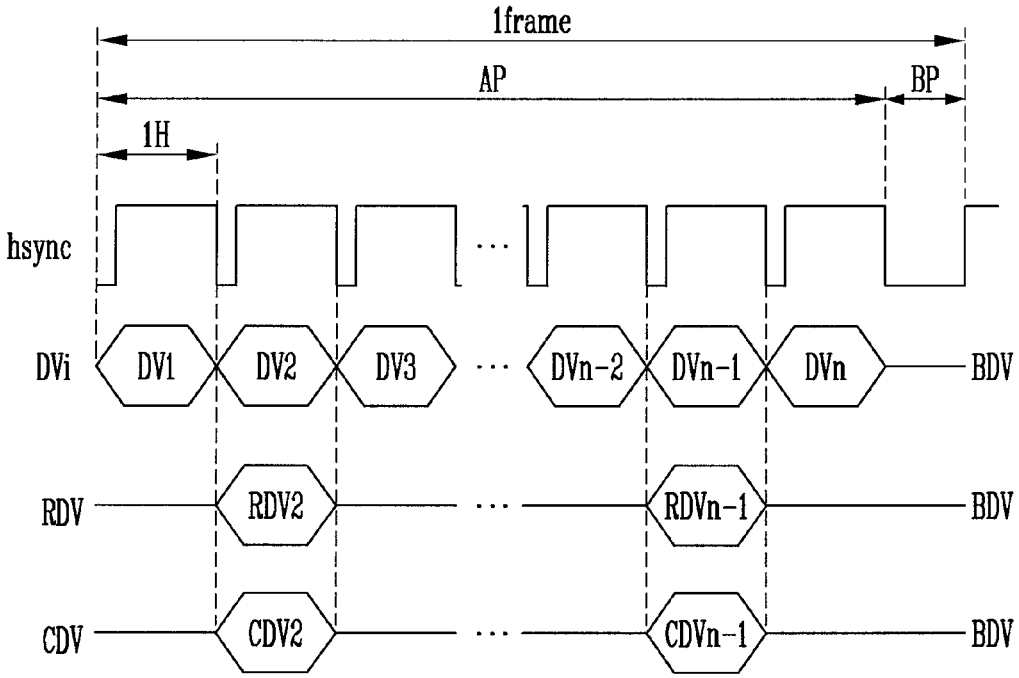
FIG. 3 is an exemplary timing diagram illustrating data voltages being output from a first data driver of FIG. 1, auxiliary data voltages being output from a second data driver, and compensation data voltages being output from a third data driver.

FIG. 3 is an exemplary timing diagram illustrating data voltages being output from a first data driver of FIG. 1, auxiliary data voltages being output from a second data driver, and compensation data voltages being output from a third data driver. FIG. 3 illustrates a horizontal sync signal (hsync), data voltages (DVi) being output to an ith data line (Di, i being a positive integer satisfying $1 \leq i \leq m$), auxiliary data voltages (RDV) being output to a first or second auxiliary data line (RD1/RD2), and compensation data voltages (CDV) being output to a first or second compensation data line (CD1/CD2).

Referring to FIG. 3, 1 frame period includes an active period (AP) where data voltages are supplied to the display pixels (DP) and a blank period (BP), which is a pausing period. In the horizontal sync signal (hsync), a pulse occurs every 1 horizontal period (1H). The data voltages (DVi) being output to the ith data line (Di) may include first to nth data voltages (DV1~DVn).

Herein, when the auxiliary pixel (RP) and compensation pixel (CP), which are adjacent to each other in a scan line direction (x axis direction), are connected to a same scan line and light emitting control line, as illustrated in FIG. 2, the auxiliary data voltage and the compensation data voltage being supplied to the auxiliary pixel and the compensation pixel, which are connected to the repaired pixel of the pth line through the auxiliary line (RL), are synchronized with the data voltage being supplied to the repaired pixel of the pth line and then supplied, as illustrated in FIG. 3. That is because the repaired pixel of the pth line and the auxiliary pixel and compensation pixel connected to the repaired pixel of the pth line through the auxiliary line (RL) receive the data voltage, auxiliary data voltage, and compensation data voltage through a same scan signal.

For example, when the first repaired pixel (RDP1) is located on a second line as illustrated in FIG. 2, the second auxiliary data voltage (RDV2) and the second compensation data voltage (CDV2) being supplied to the auxiliary pixel and the compensation pixel connected to the first repaired pixel (RDP1) through the auxiliary line (RL) may be synchronized with the second data voltage (DV2) being supplied to the first repaired pixel (RDP1) and then supplied. Furthermore, when the second repaired pixel (RDP2) is located on an (n−1)th line as illustrated in FIG. 2, the (n−1)th auxiliary data voltage (RDVn−1) and the second compensation data voltage (CDVn−1) being supplied to the auxiliary pixel and the compensation pixel connected to the second repaired pixel (RDP2) through the auxiliary line (RL) may be synchronized with the (n−1)th data voltage (DVn−1) being supplied to the second repaired pixel (RDP2) and then supplied.

Figure 4:
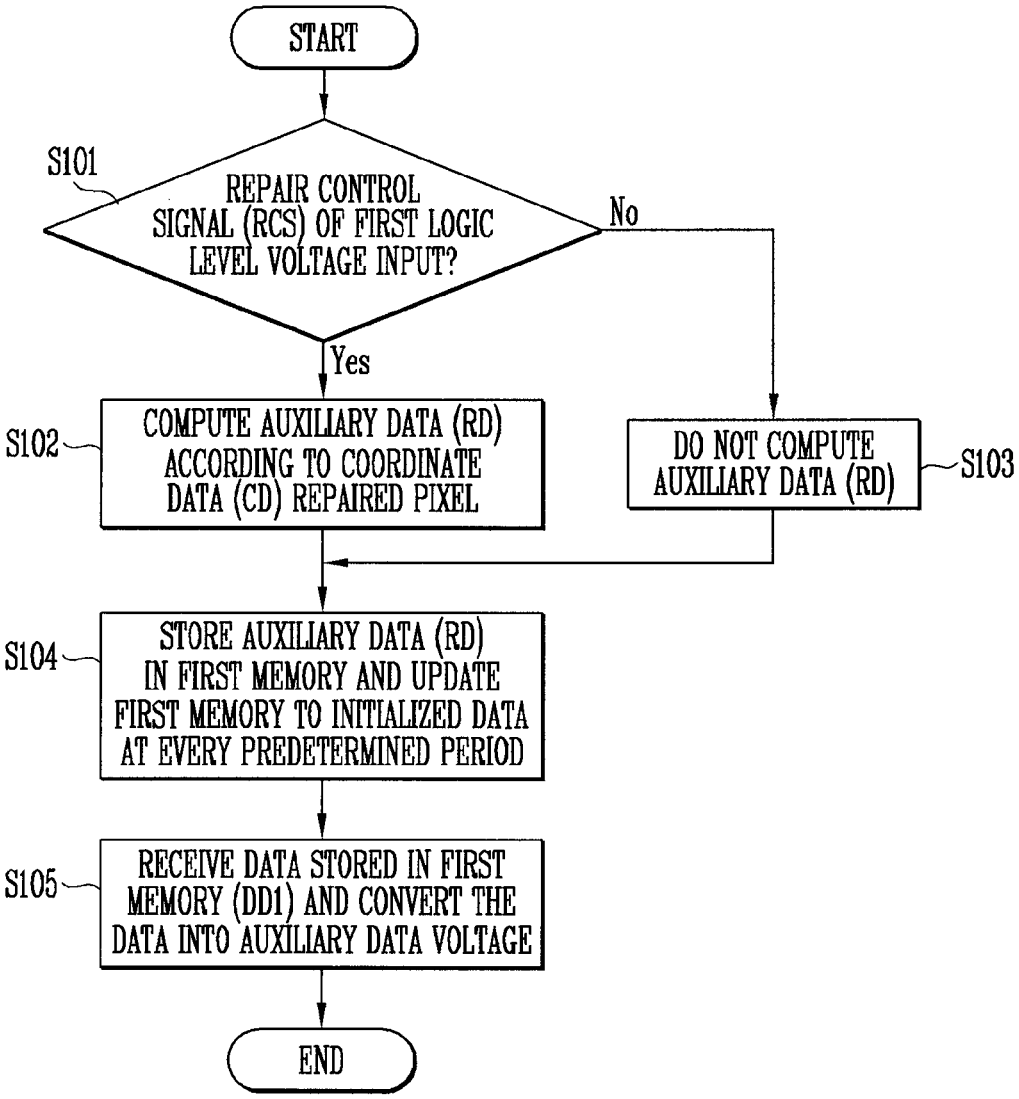
FIG. 4 is a flowchart illustrating a method for driving a second data driver of FIG. 2.

FIG. 4 is a flowchart illustrating a method for driving a second data driver of FIG. 2. Referring to FIG. 4, the method for driving the second data driver (30B) includes blocks S101 to S105.

First, the auxiliary data computing unit (1001) receives a repair control signal (RCS), a digital video data (DATA), and a coordinate data (CD) of the repaired pixel (RDP1/RDP2) from the timing controller (40). When a repair control signal (RCS) of a first logic level voltage is input, the auxiliary data computing unit (1001) computes auxiliary data (RD), and when a repair control signal (RCS) of a second logic level voltage is input, the auxiliary data computing unit (1001) does not compute auxiliary data (RD). That is, when the repair control signal (RCS) of the first logic level voltage is input, the auxiliary data computing unit (1001) computes auxiliary data (RD) from the digital video data (DATA) according to the coordinate data (CD) of the repaired pixel.

For example, the auxiliary data computing unit (1001) may compute digital video data corresponding to the coordinate value of the repaired pixel (RDP1/RDP2) as auxiliary data (RD). For example, when the first repaired pixel (RDP1) is located on a second line and second row as illustrated in FIG. 2, the coordinate value of the first repaired pixel (RDP1) may be (2,2). It should be noted that lines and rows of the display area (DA) are illustrated in FIG. 2. Furthermore, when n display pixels (DP) are arranged in a row direction (y axis direction), the second repaired pixel (RDP2) is located on the (n−1)th line and second row, such that the coordinate value of the second repaired pixel (RDP2) may be (n−1, 2).

The auxiliary data computing unit (1001) may compute digital video data corresponding to the coordinate value (2,2) as auxiliary data (RD) to be supplied to the auxiliary pixel (RP) connected to the first repaired pixel (RDP1), and compute digital video data corresponding to the coordinate value (n−1, 2) as auxiliary data (RD) to be supplied to the auxiliary pixel (RP) connected to the second repaired pixel (RDP2). The auxiliary data computing unit (1001) outputs the auxiliary data (RD) to the first memory (1002). (Refer to blocks S101, S102, and S103 of FIG. 4).

Second, the first memory (1002) receives and stores the auxiliary data (RD) from the auxiliary data computing unit (1001). The first memory (1002) may be set to be updated to initialized data at every period (e.g., every predetermined period). For example, the first memory (1002) may receive a signal that indicates a period (e.g., a predetermined period) from the timing controller (50). The signal that indicates a period (e.g., a predetermined period) may be a vertical sync signal (vsync) where a pulse occurs at every 1 frame period, or a horizontal sync signal (hsync) where a pulse occurs at every 1 horizontal period. 1 frame period refers to a period for supplying data voltages to all display pixels (DP), and 1 horizontal period refers to a period for supplying data voltages to display pixels (DP) of one line. When the signal that indicates a period (e.g., a predetermined period) is a vertical sync signal (vsync), the first memory (1002) may be updated to initialized data at every 1 frame period. When the signal that indicates a period (e.g., a predetermined period) is a horizontal sync signal (hsync), the first memory (1002) may be updated to initialized data at every 1 horizontal period. The first memory (1002) may be embodied as a register. The first memory (1002) outputs data (DD1) stored therein to the auxiliary data voltage converter (1003) at every horizontal period (in block S104 of FIG. 4).

Third, the auxiliary data voltage converter (1003) receives data (DD1) stored in the first memory (1002) and converts the data (DD1) into an auxiliary data voltage. The auxiliary data voltage converter (1003) supplies auxiliary data voltages to the auxiliary data lines (RD1/RD2). (Refer to block S105 of FIG. 4).

As aforementioned, an embodiment of the present disclosure computes digital video data (DATA) corresponding to the coordinate value of the repaired pixel (RDP1/RDP2) as auxiliary data (RD). As a result, the embodiment of the present disclosure may supply to the auxiliary pixel (RP) connected to the repaired pixel (RDP1/RDP2) an auxiliary data voltage that is the same or substantially the same as the data voltage to be supplied to the repaired pixel (RDP1/RDP2).

Figure 5:
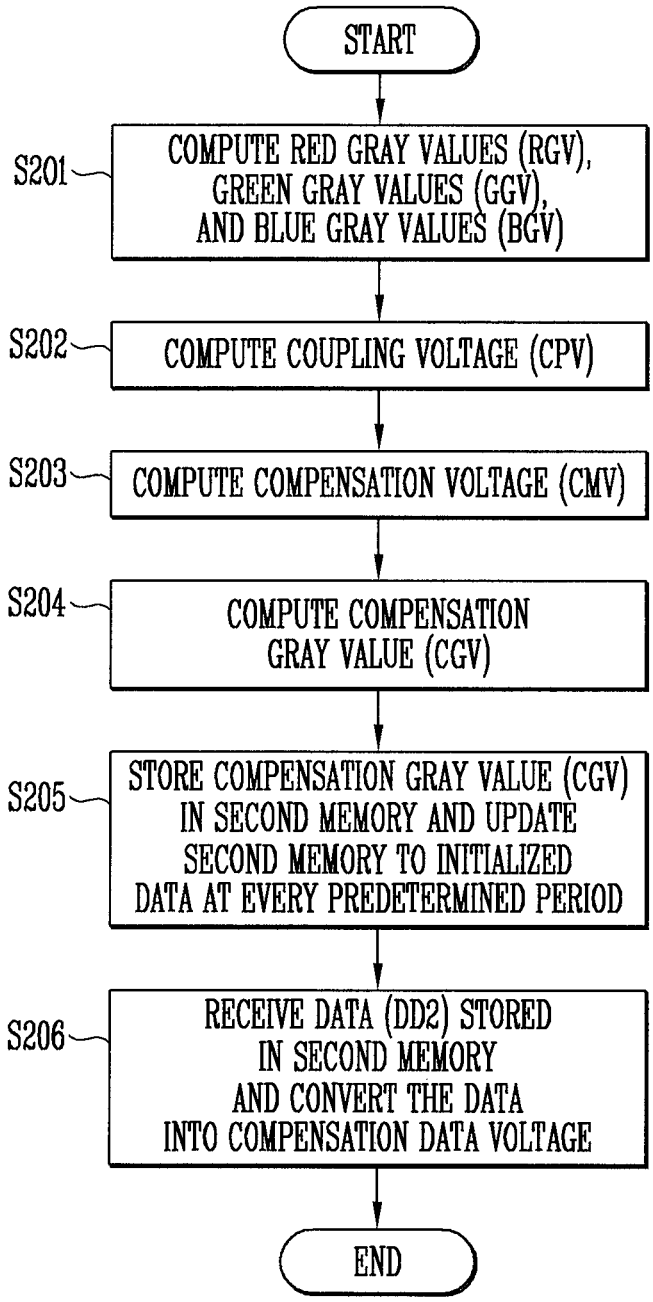
FIG. 5 is a flowchart illustrating a method for driving a third data driver of FIG. 2.

FIG. 5 is a flowchart of a method for driving a third data driver of FIG. 2. Referring to FIG. 5, the method for driving the third data driver (30C) includes blocks S201 to S206.

First, the gray value computing unit (1101) of the third data driver (30C) receives digital video data (DATA), and coordinate data (CD) of the repaired pixel (RDP1/RDP2) from the timing controller (40). When the digital video data (DATA) is 8 bit digital data, it may have 1 to 255 gray values (or gray levels).

The gray value computing unit (1101) computes red gray values being supplied to red pixels, green gray values being supplied to green pixels, and blue gray values being supplied to blue pixels, the red pixels, green pixels, and blue pixels connected to a same scan line as the repaired pixel (RDP1/RDP2). For example, the gray value computing unit (1101) may compute red gray values (RGV) being supplied to red pixels, green gray values (GGV) being supplied to green pixels (GGV), and blue gray values (BGV) being supplied to blue pixels, the red pixels, green pixels, and blue pixels connected to a same scan line as the repaired pixel (RDP1/RDP2), according to the coordinate value of the repaired pixel (RDP1/RDP2).

For example, when the first repaired pixel (RDP1) is located on a second line and a second row as illustrated in FIG. 2, the coordinate value of the first repaired pixel (RDP1) may be (2,2). In such a case, of the display pixels (DP) having coordinate values (2,1) to (2,m), it is possible to compute red gray values (RGV) being supplied to red pixels, green gray values, (GGV) being supplied to green pixels, and blue gray values (BGV) being supplied to blue pixels of the display pixels (DP) having coordinate values (2,1) to (2,m).

Furthermore, when n number of display pixels (DP) are arranged in a row direction (y axis direction), the second repaired pixel (RDP2) is located on a (n−1)th line and second row, and thus the coordinate value of the second repaired pixel (RDP2) may be (n−1,2). In such a case, of the display pixels (DP) having a coordinate value of (n−1,1) to (n−1,m), red gray values (RGV) being supplied to red pixels, green gray values (GGV) being supplied to green pixels, and blue gray values (BGV) being supplied to blue pixels may be computed.

The gray value computing unit (1101) may output red gray values (RGV), green gray values (GGV), and blue gray values (BGV) to the coupling voltage computing unit (110). (Refer to block S201 of FIG. 5).

Second, the coupling voltage computing unit (1102) of the third data driver (30C) receives red gray values (RGV), green gray values (GGV), and blue gray values (BGV) from the gray value computing unit (1101). The coupling voltage computing unit (1102) computes a coupling voltage that is a voltage at which the auxiliary line (RL) is affected by the auxiliary line (RL) by the red pixels, green pixels, and blue pixels connected to a same scan line as the repaired pixel (RDP1/RDP2) using the red gray values (RGV), green gray values (GGV) and blue pixels (BGV).

For example, the coupling voltage computing unit (1102) computes a red anode voltage (RVanode) being supplied to an anode electrode of the red organic light emitting diode according to each of the red gray values (RGV); computes a green anode voltage (GVanode) being supplied to an anode electrode of the green organic light emitting diode according to each of the green gray values (GGv); and computes a blue anode voltage (BVanode) being supplied to an anode electrode of the blue organic light emitting diode according to each of the blue gray values (BGV). On an x axis of the graph illustrated in FIG. 6, the gray value (GV) of 8 bit digital video data is shown, and on a y axis, an anode voltage (Vanode) of the organic light emitting diode is shown. The graph illustrated in FIG. 6 is a graph computed by calculation after determining a current, voltage, and brightness of the organic light emitting diode of each of the red, green, and red display pixels, transmissivity of a polarized panel attached to the display panel, and an opening ratio and maximum brightness of each of the display pixels, and gamma value.

Figure 6:
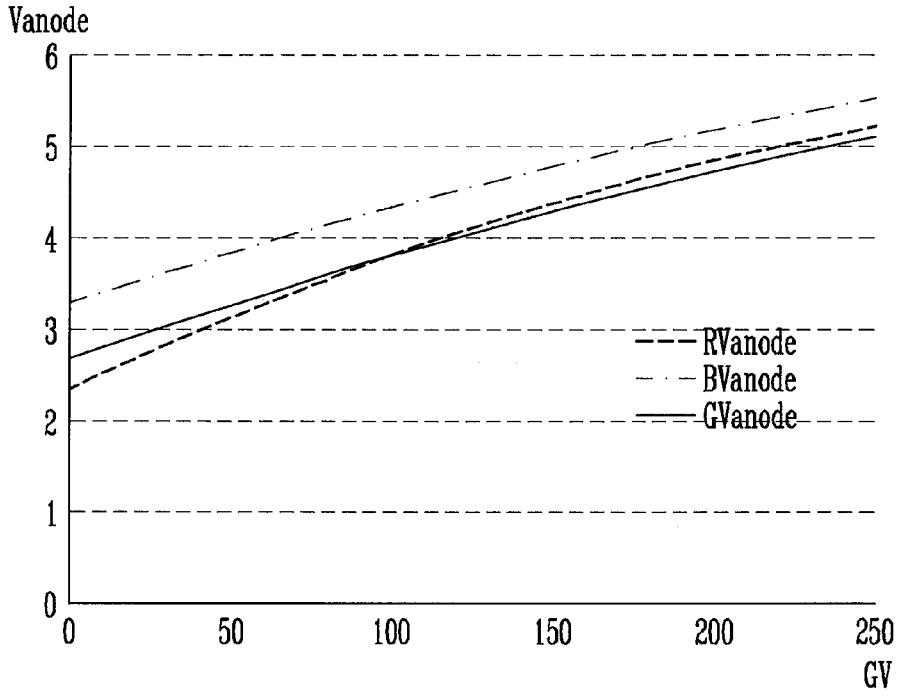
FIG. 6 is a graph illustrating voltages applied to an anode electrode of an organic light emitting diode according to a red gray value, green gray value, and blue gray value.

The graph illustrated in FIG. 6 may be embodied as a red look-up table that receives a red gray value (RGB) as an input address and outputs a red anode voltage (RVanode), a green look-up table that receives a green gray value (GGV) as an input address and outputs a green anode voltage (GVanode), and a blue look-up table that receives a blue gray value (BGV) as an input address and outputs a blue anode electrode (BVanode). In this case, the coupling voltage computing unit (1102) may compute red anode voltages (RVanode) according to the red gray values (RGV) using the red look-up table, compute green anode voltages (GVanode) according to green gray values (GGV) using the green look-up table, and blue anode voltages (BVanode) according to the blue gray value (BGV) using the blue look-up table.

The coupling voltage computing unit (1102) computes the red coupling voltage (RCV) from the red anode voltage (RVanode) using Equations 1 and 2.

$$\Delta RV = RVanode - (VIN1 - ELVSS) \quad \text{Equation 1}$$

$$RCV = \Delta RV \times \frac{Crp}{Cptotal} \quad \text{Equation 2}$$

In Equations 1 and 2, RVanode refers to the red anode voltage of the red pixel, VIN1 refers to the first power voltage, ELVSS refers to the fourth power voltage, Crp refers to the parasitic capacitance between the anode electrode of the organic light emitting diode of the red pixel and the auxiliary line (RL), and Cptotal refers to a total sum of the parasitic capacitances of the auxiliary line (RL).

The voltage computing unit (1102) computes the green coupling voltage (GCV) from the green anode voltage (GVanode) using Equations 3 and 4.

$$\Delta GV = GVanode - (VIN1 - ELVSS) \quad \text{Equation 3}$$

$$GCV = \Delta GV \times \frac{Cgp}{Cptotal} \quad \text{Equation 4}$$

In Equations 3 and 4, GVanode refers to the green anode voltage of the green pixel, VIN1 refers to the first power voltage, ELVSS refers to the fourth power voltage, Cgp refers to the parasitic capacitance between the anode electrode of the organic light emitting diode of the green pixel and the auxiliary line (RL), and Cptotal refers to a total sum of the parasitic capacitances of the auxiliary line (RL).

The coupling voltage computer (1102) computes the blue coupling voltage (BCV) from the blue anode voltage (BVanode) using Equations 5 and 6.

$$\Delta BV = BVanode - (VIN1 - ELVSS) \quad \text{Equation 5}$$

$$BCV = \Delta BV \times \frac{Cbp}{Cptotal} \quad \text{Equation 6}$$

In Equations 5 and 6, BVanode refers to the blue anode voltage of the blue pixel, VIN1 refers to the first power voltage, ELVSS refers to the fourth power voltage, Cgp refers to the parasitic capacitance between the anode electrode of the organic light emitting diode of the blue pixel and the auxiliary line (RL), and Cptotal refers to a total sum of the parasitic capacitances of the auxiliary line (RL).

Figure 7:
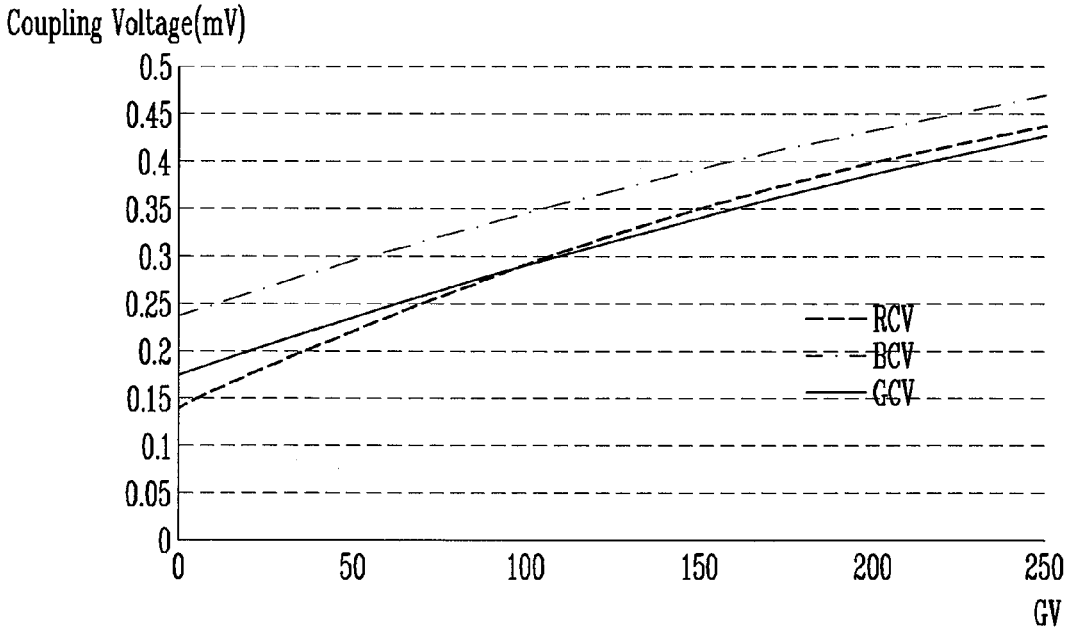
FIG. 7 is a graph illustrating a coupling voltage according to a red gray value, green gray value, and blue gray value.

Each of the red coupling voltage (RCV), green coupling voltage (GCV), and blue coupling voltage (BCV) computed using Equations 1 to 6 may be computed to be roughly proportional to the gray value as illustrated in FIG. 7. On an x axis of the graph illustrated in FIG. 7, the gray value (GV) of 8 bit digital video data is shown, and on a y axis, a coupling voltage is shown.

The coupling voltage computing unit (1102) computes a total sum of a total sum of the red coupling voltages (RCV), a total sum of the green coupling voltages (GCV), and a total sum of the blue coupling voltages (BCV) as a coupling voltage (CPV).

$$CV = \Sigma RCV + \Sigma GCV + \Sigma BCV \quad \text{Equation 7:}$$

The coupling voltage computing unit (1102) outputs the coupling voltage (CPV) to the compensation voltage computing unit (1103). (Refer to block S202 of FIG. 5)

Third, the compensation voltage computing unit (1103) receives the coupling voltage (CPV) from the coupling voltage computing unit (1102). The compensation voltage computing unit (1103) computes a difference between a maximum coupling voltage (MaxCPV) and a coupling voltage (CPV) as a compensation voltage (CMV) as illustrated in Equation 8.

$$CMV = MaxCPV - CPV \quad \text{Equation 8:}$$

Figure 8:
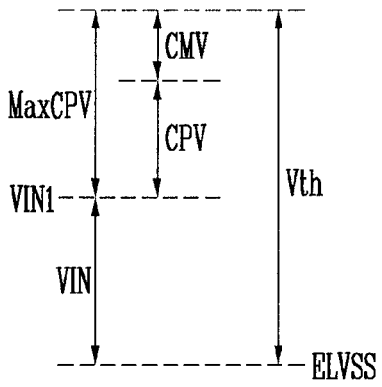
FIG. 8 is a view illustrating a first initialization voltage, first power voltage, and a threshold voltage of an organic light emitting diode.

Referring to FIG. 8, the first power voltage (VIN1) is set to a voltage equivalent to sum of a voltage (e.g., a predetermined voltage) (VIN) and a fourth power voltage (ELVSS). Furthermore, in order to prevent or substantially preventing erroneous light emitting of the organic light emitting diode connected to the auxiliary line (RL) by the coupling voltage generated by parasitic capacitances formed between the auxiliary line (RL) and display pixels (DP), a threshold voltage (Vth) of the organic light emitting diode connected to the auxiliary line (RL) is set to a voltage equivalent to a sum of a voltage (e.g., a predetermined voltage) (VIN) and a maximum coupling voltage (MaxCPV). The coupling voltage (CPV) refers to the coupling voltage generated by the parasitic capacitances formed between the auxiliary line (RL) and display pixels (DP), and the maximum coupling voltage (MaxCPV) refers to the maximum value of the coupling voltage (CPV).

Additionally, the coupling voltage (CPV) differs depending on a gray value that the display pixels (DP) display. For example, the higher the gray value that the display pixels (DP) display, the higher the coupling voltage (CPV), and the lower the gray value that the display pixels (DP) display, the lower the coupling voltage (CPV). Because the threshold voltage (Vth) of the organic light emitting diode of the auxiliary pixel (RP) is set to a voltage equivalent to a sum of a voltage (e.g., a predetermined voltage) (VIN) and the maximum coupling voltage (MaxCPV), in order to prevent or substantially prevent the potential of the auxiliary line (RL) from changing according to the coupling voltage (CPV), a difference between the maximum coupling voltage (MaxCPV) and the coupling voltage (CPV) is computed as a compensation voltage (CMV). As a result, because the embodiment of the present disclosure may set the potential of the auxiliary line (RL) to be substantially the same as the threshold voltage (Vth) of the organic light emitting diode regardless of the coupling voltage (CPV), it is possible to prevent or substantially prevent the organic light emitting diode of the repaired pixel from erroneously emitting light.

The compensation voltage computing unit (1103) outputs the compensation voltage (CMV) to the compensation gray value computing unit (1104). (S203 of FIG. 5).

Figure 9:
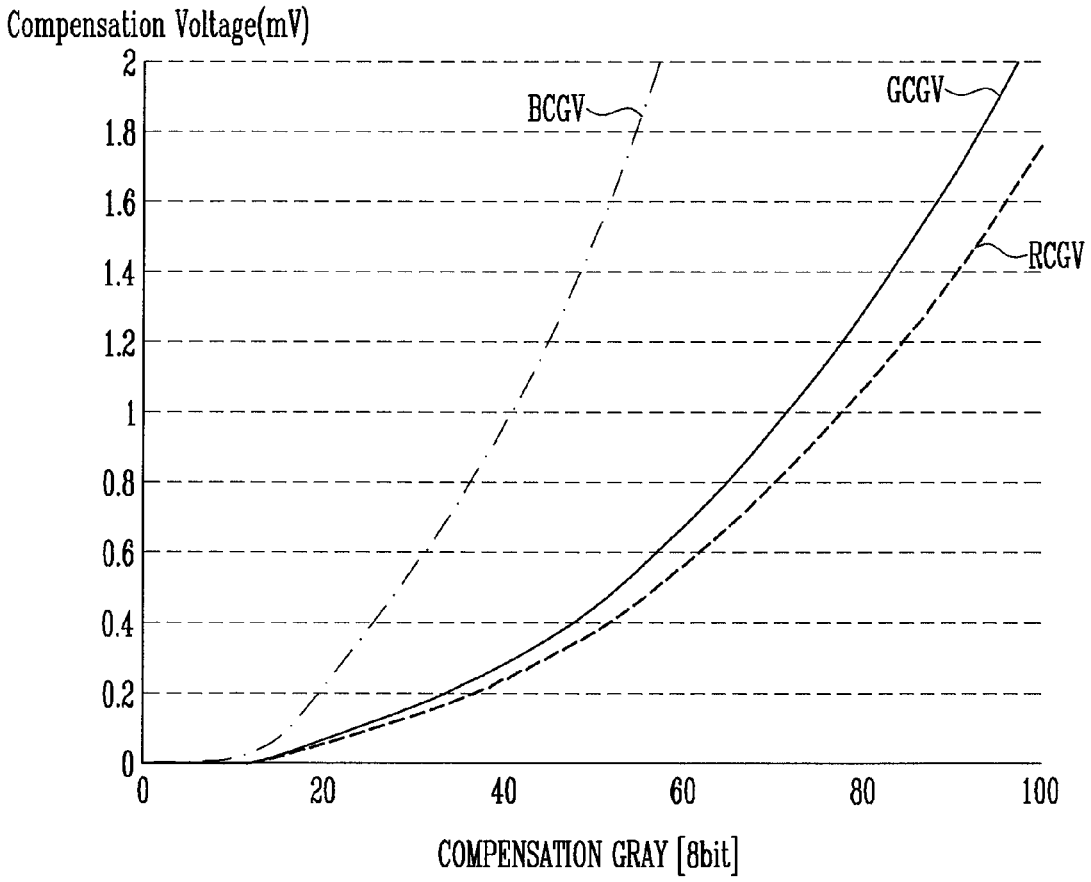
FIG. 9 is a graph illustrating compensation data voltages according to a red compensation gray value, green compensation gray value, and blue compensation gray value.

Fourth, the compensation gray value computing unit (1104) receives the compensation voltage (CMV) from the compensation voltage computing unit (1103). The compensation gray value computing unit (1104) computes the compensation gray value (CGV) according to the compensation voltage (CMV). The compensation gray value computing unit (1104) may compute a compensation gray value (CGV) depending on which of among a red pixel, green pixel, and blue pixel the repaired pixel (RDP1/RDP2) is, as illustrated in FIG. 9. On x axis of FIG. 9, a compensation gray value (CGV) is shown, and on y axis, a compensation voltage (CMV) is shown.

The graph illustrated in FIG. 9 may be embodied as a look-up table that receives a compensation gray value (CGV) as an input address, and outputs a compensation gray value (CGV) depending on which among a red pixel, green pixel, and blue pixel the repaired pixel (RDP1/RDP2) is. In this case, when the repaired pixel (RDP1/RDP2) is a red pixel, the compensation gray value computing unit (1104) may receive the compensation gray value (CGV) as an input address, and compute a compensation gray value (CGV) according a red compensation voltage graph (RCGV). Furthermore, when the repaired pixel (RDP1/RDP2) is a green pixel, the compensation gray value computing unit (1104) may receive a compensation gray value (CGV) as an input address, and compute a compensation gray value (CGV) according to a green compensation voltage graph (GCGV). When the repaired pixel (RDP1/RDP2) is a blue pixel, the compensation gray value computing unit (1104) may receive a compensation gray value (CGV) as an input address, and compute a compensation gray value (CGV) according to a blue compensation voltage graph (BCGV).

The compensation gray value computing unit (1104) outputs the compensation gray value (CGV) to the second memory (1105). (S204 of FIG. 5)

Fifth, the second memory (1105) receives and stores the compensation gray value (CGV) from the compensation gray value computing unit (1104). The second memory (1105) may be set to be updated to initialized data at every period (e.g., every predetermined period). For example, the second memory (1105) may receive a signal that indicates a period (e.g., a predetermined period) from the timing controller (40). The signal that indicates the period (e.g., the predetermined period) may be a vertical sync signal (vsync) where a pulse occurs at every 1 frame period, or a horizontal sync signal (hsync) where a pulse occurs at every 1 horizontal period. When the signal that indicates the period (e.g., the predetermined period) is a vertical sync signal (vsync), the second memory (1105) may be updated to initialized data at every 1 frame period. When the signal that indicates the period (e.g., the predetermined period) is a horizontal sync signal (hsync), the second memory (1105) may be updated to initialized data at every 1 horizontal period. The second memory (1105) may be embodied as a register. The second memory (1105) outputs data (DD2) stored therein to the auxiliary data voltage converter (1106) at every horizontal period. (Refer to block S205 of FIG. 5)

Sixth, the auxiliary data voltage converter (1106) receives the data stored in the second memory (1105) and converts the received data into an auxiliary data voltage. The auxiliary data voltage converter (1106) supplies auxiliary data voltages to the auxiliary data line (RD1/RD2). (Refer to block S206 of FIG. 5)

As aforementioned, the embodiment of the present disclosure computes a coupling voltage generated by parasitic capacitances formed between display pixels (DP) connected to a same scan line as the repaired pixel (RDP1/RDP2), computes a compensation gray value using the coupling voltage generated, and outputs a compensation data voltage to a compensation pixel (CP) using the compensation gray value. As a result, the embodiment of the present disclosure may supply a compensation current to an auxiliary line (RL) using the compensation pixel (CP), and thus it is possible to compensate a change of potential of the auxiliary line (RL) by the coupling voltage generated by parasitic capacitances formed between display pixels (DP) connected to a same scan line as the repaired pixel (RDP1/RDP2).

Figure 10:
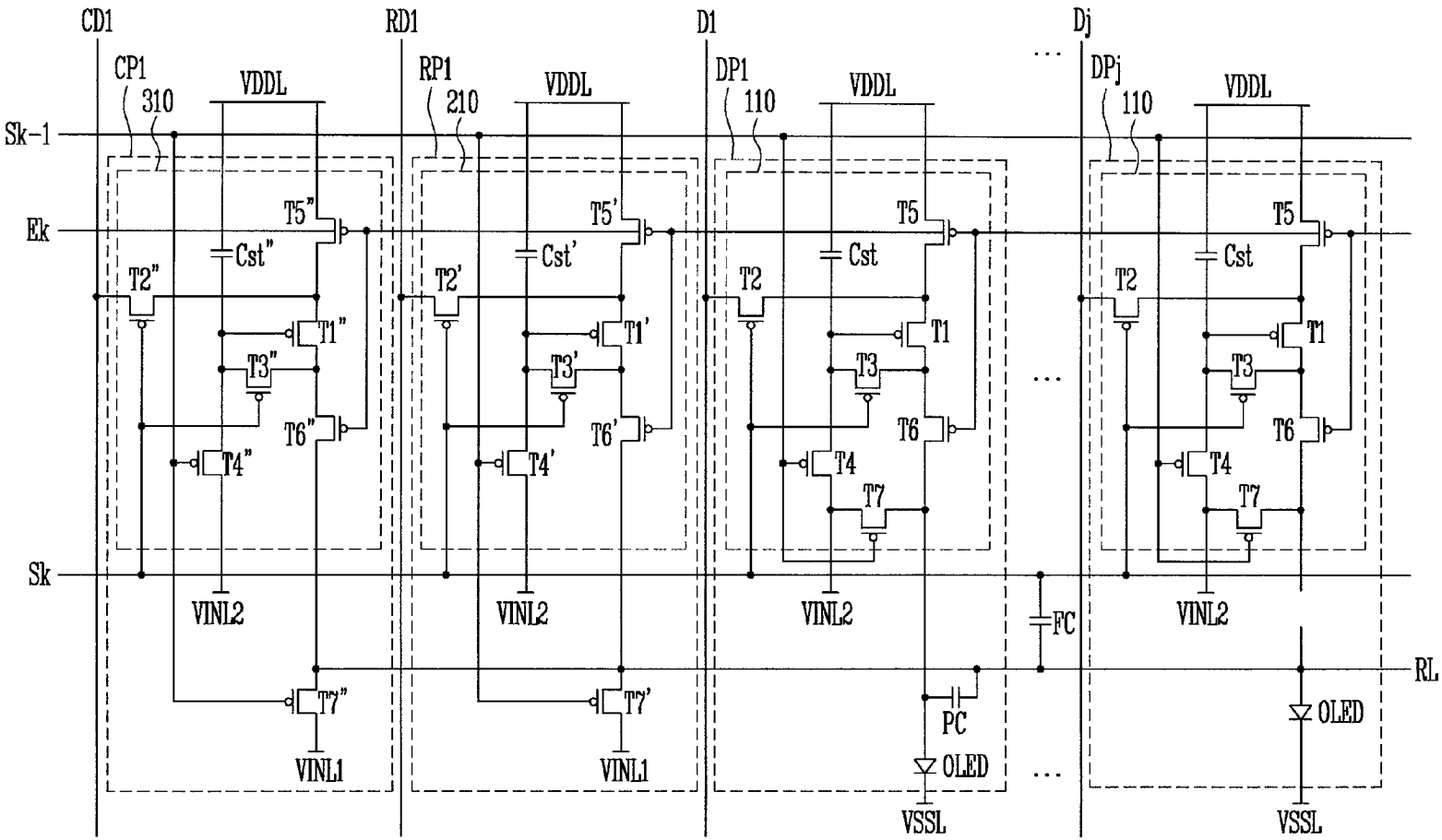
FIG. 10 is an exemplary view illustrating display pixels, auxiliary pixels, and compensation pixels according to an embodiment of the present disclosure.

FIG. 10 is an exemplary view illustrating display pixels, auxiliary pixels, and compensation pixels according to an embodiment of the present disclosure. FIG. 10 illustrates only (k−1)th and kth scan lines (Sk−1, Sk, k being a positive integer satisfying $2 \le k \le n$), a first auxiliary data line (RD1), a first compensation data line (CD1), a first and jth data line (D1, Dj, j being a positive integer satisfying $2 \le j \le m$), and kth and k+αth light emitting control lines (Ek and Ek+α) for convenience of explanation. Furthermore, FIG. 10 illustrates only a first compensation pixel (CP1) connected to the first compensation data line (CD1), a first auxiliary pixel (RP1) connected to the first auxiliary data line (RD1), a first display pixel (DP1) connected to the first data line (D1), and jth display pixel (DPj) connected to the jth data line (Dj). In FIG. 10, it is to be noted that the first display pixel (DP1) is a pixel where a defect did not occur in a manufacturing process, and that the jth display pixel (DPj) is a pixel where a defect occurred in the manufacturing process and thus repaired. Hereinafter, the first compensation pixel (CP1), the first auxiliary pixel (RP1), the first display pixel (DP1), and the jth display pixel (DPj) will be explained in more detail with reference to FIG. 10.

Referring to FIG. 10, the first auxiliary pixel (RP1) and the first compensation pixel (CP1) are connected to the jth display pixel (DPj) through an auxiliary line (RL). The auxiliary line (RL) may be connected to the first auxiliary pixel (RP1) and first compensation pixel (CP1), and to extend from the first auxiliary pixel (RP1) to a display area (DA) to cross (e.g., to intersect) display pixels (DP1 and DPj). For example, the auxiliary line (RL) may be formed to cross anode electrodes of the organic light emitting diode (OLED) of the display pixels (DP1 and DPj) as illustrated in FIG. 10.

The auxiliary line (RL) may be connected to an organic light emitting diode (OLED) of the jth display pixel (DPj). In this case, the display pixel driver (110) of the jth display pixel (DPj) and the organic light emitting diode (OLED) are disconnected from each other.

Each of the display pixels (DP1 and DPj) includes an organic light emitting diode (OLED) and a display pixel driver (110).

A display pixel driver (110) of each of the display pixels (DP1, DPj) is coupled to an organic light emitting diode (OLED), and supplies a driving current to the organic light emitting diode (OLED). However, a display pixel driver (110) of a jth display pixel (DPj) corresponding to a repaired pixel and the organic light emitting diode (OLED) are decoupled from (e.g., disconnected from) each other.

The display pixel driver (110) may be connected to a plurality of scan lines, a data line, a light emitting control line, and a plurality of power lines. The display pixel driver (110) may be connected to (k−1)th and kth scan lines (Sk−1 and Sk), data line (D1/Dj), kth light emitting control line (Ek), and second and third power voltage lines (VDDL and VINL2) as illustrated in FIG. 10. To the second power voltage line (VINL2), a second power voltage is supplied, and to a third power voltage line (VDDL), a third power voltage is supplied. The second power voltage may be an initialization power voltage for initializing the display pixel driver (110), and the third power voltage may be a high potential power voltage. It is to be noted that the second power voltage is a different voltage from the first power voltage. For example, the first power voltage may be set to a voltage that is substantially the same as a fourth power voltage or a sum of the fourth power voltage and a voltage (e.g., a predetermined voltage), and the second power voltage may be set to a DC voltage (e.g., a predetermined DC voltage) such as −3.5V.

The display pixel driver (110) may include a plurality of transistors. For example, the display pixel driver (110) may include first to seventh transistors (T1, T2, T3, T4, T5, T6, T7) and a storage capacitor (Cst).

The first transistor (T1) controls a driving current (e.g., drain-source current, Ids) according to the voltage of a control electrode. The driving current (Ids) that flows through a channel of the first transistor (T1) is proportional to a square of a difference between a threshold voltage and a voltage (voltage between gate-source) between the control electrode of the first transistor (T1) and the first electrode as in equation below.

$$I_{ds}=k'\cdot(V_{gs}-V_{th})^2 \qquad \text{Equation 9:}$$

In equation 9, k' refers to a multiplicative factor (or coefficient) determined by a structure and physical characteristics of the first transistor (T1), Vgs refers to a voltage between the control electrode of the first transistor (T1) and the first electrode, and Vth refers to a threshold voltage of the first transistor (T1).

The second transistor (T2) is connected to a first electrode of the first transistor (T1) and data lines (D1/Dj). The second transistor (T2) is turned on by a scan signal of the kth scan line (Sk) and is connected to the first electrode of the first transistor (T1) and the data lines (D1~Dj). Thus, to the first electrode of the first transistor (T1), a data voltage of the data lines (D1/Dj) is supplied. A control electrode of the second transistor (T2) is connected to the kth scan line (Sk), the first electrode is connected to the data lines (D1/Dj), and the second electrode is connected to the first electrode of the first transistor (T1). Herein, the control electrode may be a different electrode from the gate electrode, the first electrode may be a different electrode from the source electrode or drain electrode, and the second electrode may be a different electrode from the first electrode. For example, when the first electrode is a source electrode, the second electrode may be a drain electrode.

The third transistor (T3) is connected to the control electrode and the second electrode of the first transistor (T1). The third transistor (T3) is turned on by a scan signal of the kth scan line (Sk) and is connected to the control electrode and the second electrode of the first transistor (T1). In this case, because the control electrode and the second electrode of the first transistor (T1) are connected to each other, the first transistor (T1) is driven as a diode. A control electrode of a third transistor (T3) is connected to the kth scan line (Sk), and the first electrode is connected to the second electrode of the first transistor (T1), and the second electrode is connected to the control electrode of the first transistor (T1).

The fourth transistor (T4) is connected to a second power voltage line (VINL2) to which the control electrode and the second power voltage of the first transistor (T1) are supplied. The fourth transistor (T4) is turned on by the scan signal of the (k−1)th scan line (Sk−1), and is connected to the control electrode and the second power voltage line (VINL2) of the first transistor (T1). Thus, the control electrode of the first transistor (T1) may be initialized by the second power voltage. The control electrode of the fourth transistor (T4) is connected to the (k−1)th scan line (SK−1), the first electrode is connected to the control electrode of the first transistor (T1), and the second electrode is connected to the second power voltage line (VINL2).

The fifth transistor (T5) is connected to the third power voltage line (VDDL) and the first electrode of the first transistor (T1). The fifth transistor (T5) is turned on by a light emitting control signal of the kth light emitting control line (Ek) and is connected to the third power voltage line (VDDL) and the first electrode of the first transistor (T1). Thus, to the first electrode of the first transistor (T1), the third power voltage is supplied. The control electrode of the fifth transistor (T5) is connected to the kth light emitting control line (Ek), the first electrode is connected to the third power voltage line (VDDL), and the second electrode is connected to the first electrode of the first transistor (T1).

The sixth transistor (T6) is connected to the second electrode and the organic light emitting diode (OLED) of the first transistor (T1). The sixth transistor (T6) is turned on by a light emitting control signal of the kth light emitting control line (Ek) and is connected to the second electrode and the organic light emitting diode (OLED) of the first transistor (T1). The control electrode of the sixth transistor (T6) is connected to the kth light emitting control line (Ek), the first electrode is connected to the second electrode of the first transistor (T1), and the second electrode is connected to the organic light emitting diode (OLED).

When the fifth and sixth transistors (T5 and T6) are turned on, the driving current (Ids) of the display pixel driver (110) is supplied to the organic light emitting diode (OLED). Thus, the organic light emitting diode (OLED) of the first display pixel (DPI) emits light.

The seventh transistor (T7) is connected to an anode electrode of the organic light emitting diode (OLED) and the second power voltage line (VINL2). The seventh transistor (T7) is turned on by a scan signal of the (k−1)th scan line (Sk−1) and is connected to the anode electrode of the organic light emitting diode (OLED) and the second power voltage line (VINL2). Thus, the anode electrode of the organic light emitting diode (OLED) is discharged to the second power voltage. The control electrode of the seventh transistor (T7) is connected to the (k−1)th scan line (Sk−1), the first electrode is connected to the anode electrode of the organic light emitting diode (OLED), and the second electrode is connected to the second power voltage line (VINL2).

The organic light emitting diode (OLED) emits light according to the driving current (Ids) of the display pixel driver (110). The amount of light emission by the organic light emitting diode (OLED) may be proportional to the driving current (Ids). The anode electrode of the organic light emitting diode (OLED) is connected to the first electrode of the second transistor (T2) and the second electrode of the seventh transistor (T7), and the cathode electrode is connected to the fourth power voltage line (VSSL). To the fourth power voltage line (VSSL), the fourth power voltage is supplied.

The storage capacitor (Cst) is connected to the control electrode of the first transistor (T1) and the third power voltage line (VDDL), and maintains the voltage of the control electrode of the first transistor (T1). An electrode at one side of the storage capacitor (Cst) is connected to the control electrode of the first transistor (T1), and an electrode at the other side is connected to the third power voltage line (VDDL).

Additionally, FIG. 10 exemplifies that first to seventh transistors (T1~T7) are embodied as PMOS transistors, but there is no limitation thereto. That is, the first to seventh transistors (T1~T7) may be embodied as NMOS transistors instead.

Each of the auxiliary pixels (RP1) includes an auxiliary pixel driver (210). Each of the auxiliary pixels (RP1) does not include an organic light emitting diode (OLED).

The auxiliary pixel driver (210) is connected to an auxiliary line (RL). Thus, the driving current of the auxiliary pixel driver (210) is supplied to the organic light emitting diode (OLED) of the jth display pixel (DPj) through the auxiliary line (RL).

The auxiliary pixel driver (210) may be connected to a plurality of scan lines, auxiliary data lines, a plurality of light emitting control lines, and a plurality of power lines. The auxiliary pixel driver (210) may be connected to (k−1)th and kth scan lines (Sk−1 and Sk), the first auxiliary data line (RD1), kth light emitting control lines (Ek), and first to third power voltage lines (VINL1, VINL2, and VDDL).

The auxiliary pixel driver (210) may include a plurality of transistors. For example, the auxiliary pixel driver (210) may include first to seventh transistors (T1', T2', T3', T4', T5', T6', and T7').

The first, third, fourth, and fifth transistors (T1', T3', T4', and T5') and the storage capacitor (Cst') of the auxiliary pixel driver (210) may be formed substantially the same as the first, third, fourth, and fifth transistors (T1, T3, T4, and T5) and the storage capacitor (Cst) of the auxiliary pixel driver (110). Therefore, detailed explanation on the first, third, fourth, and fifth transistors (T1', T3', T4', and T5') and the storage capacitor (Cst') of the auxiliary pixel driver (210) may not be provided.

The second transistor (T2') is connected to the first electrode and first auxiliary data line (RD1) of the first transistor (T1'). The second transistor (T2') is turned on by the scan signal of the kth scan line (Sk) and is connected to the first electrode and first auxiliary data line (RD1) of the first transistor (T1'). Thus, to the first electrode of the first transistor (T1'), an auxiliary data voltage of the first auxiliary data line (RD1) is supplied. The control electrode of the second transistor (T2') is connected to the kth scan line (Sk), and the first electrode is connected to the first auxiliary data line (RD1), and the second electrode is connected to the first electrode of the first transistor (T1').

The sixth transistor (T6') is connected to the second electrode and auxiliary line (RL) of the first transistor (T1'). The sixth transistor (T6') is turned on by a light emitting control signal of the kth light emitting control line (Ek) and is connected to the second electrode and auxiliary line (RL) of the first transistor (T1'). The control electrode of the sixth transistor (T6') is connected to the kth light emitting control line (Ek), the first electrode is connected to the second electrode of the first transistor (T1'), and the second electrode is connected to the auxiliary line (RL). When the 4'th and 5'th transistors (T4' and T5') are turned on, a driving current (Ids') is supplied to the organic light emitting diode (OLED) of the jth display pixel (DPj) through the auxiliary line (RL), and thus the organic light emitting diode (OLED) of the jth display pixel (DPj) emits light.

The seventh transistor (T7') is connected to the auxiliary line (RL) and first power voltage line (VINL1). The seventh transistor (T7') is turned on by a scan line of the (k−1)th scan line (Sk−1) and is connected to the auxiliary line (RL) and first power voltage line (VINL1). Thus, the auxiliary line (RL) is discharged as a first power voltage. The control electrode of the seventh transistor (T7') is connected to the (k−1)th scan line (Sk−1), the first electrode is connected to the auxiliary line (RL), and the second electrode is connected to the first power voltage line (VINL1).

Additionally, FIG. 10 exemplifies that the first to seventh transistors (T1'~T7') are embodied as PMOS transistors, but there is no limitation thereto. That is, the first to seventh transistors (T1'~T7') may be embodied as NMOS transistors.

Each of the compensation pixels (CP1) includes a compensation pixel driver (310). Each of the compensation pixels (CP1) does not include an organic light emitting diode (OLED).

The compensation pixel driver (310) is connected to the auxiliary line (RL). Thus, the driving current of the compensation pixel driver (310) is supplied to the organic light emitting diode (OLED) of the jth display pixel (DPj) through the auxiliary line (RL).

The compensation pixel driver (310) may be connected to a plurality of scan lines, an auxiliary data line, a plurality of light emitting control lines, and a plurality of power lines. As illustrated in FIG. 10, the compensation pixel driver (310) may be connected to the (k−1)th and kth scan lines (Sk−1 and Sk), first compensation data line (CD1), the kth light emitting control lines (Ek), and first to third power voltage lines (VINL1, VINL2, and VDDL) as in FIG. 10.

The compensation pixel driver (310) may include a plurality of transistors. For example, the compensation pixel driver (310) may include first to seventh transistors (T1", T2", T3", T4", T5", T6", and T7"). Also, the seventh transistor (T7") of the compensation pixel driver (310) may be omitted.

The first, and third to seventh transistors (T1", T3", T4", T5", T6", and T7") and the storage capacitor (Cst") of the compensation pixel driver (310) may be formed substantially the same as the first, and third to seventh transistors (T1', T3', T4', T5', T6', and T7'), and the storage capacitor (Cst') of the compensation pixel driver (210). Therefore, detailed explanation on the first, and the third to the seventh transistors (T1", T3", T4", T5", T6", and T7"), and the storage capacitor (Cst") of the compensation pixel driver (310) may not be provided.

The second transistor (T2") is connected to the first electrode and the first compensation data line (CD1) of the first transistor (T1"). The second transistor (T2") is turned on by a scan signal of the kth scan line (Sk) and is connected to the first electrode and the first compensation data line (CD1) of the first transistor (T1"). Thus, to the first electrode of the first transistor (T1"), the compensation data voltage of the first compensation data line (CD1) is supplied. The control electrode of the second transistor (T2") is connected to the kth scan line (Sk), the first electrode is connected to the first compensation data line (CD1), and the second electrode is connected to the first electrode of the first transistor (T1").

As aforementioned, the display pixel driver (110) of the display pixels (DP1) neighboring (e.g., besides) the jth display pixel (DPj) corresponding to the repaired pixel is connected to the organic light emitting diode (OLED), and supplies the driving current to the organic light emitting diode (OLED). However, the display pixel driver (110) of the jth display pixel (DPj) is not connected to the organic light emitting diode (OLED). That is, because the display pixel driver (110) of the jth display pixel (DPj) cannot play its role due to its defect, it disconnects from the organic light emitting diode ((OLED) and connects the anode electrode of the organic light emitting diode (OLED) of the jth display pixel (DPj) to the auxiliary line (RL). Thus, the anode electrode of the organic light emitting diode (OLED) of the jth display pixel (DPj) may be connected to the auxiliary pixel driver (210) of the first auxiliary pixel (RP1) and the compensation pixel driver (310) of the first compensation pixel (CP1) through the auxiliary line (RL). Thus, the organic light emitting diode (OLED) of the jth display pixel (DPj) may be provided with the driving current from the auxiliary pixel driver (210) of the first auxiliary pixel (RP1), and receives the compensation current from the first compensation pixel driver (310), and emits light. As a result, the jth display pixel (DPj) may be repaired.

FIG. 10 exemplifies a first auxiliary pixel (RP1) as an auxiliary pixel for convenience of explanation, and each of the auxiliary pixels may be embodied substantially the same as the first auxiliary pixel (RP1). Furthermore, FIG. 10 exemplifies a first compensation pixel (CP1) as a compensation pixel, and each of the compensation pixels may be embodied substantially the same as the first compensation pixel (CP1). Furthermore, FIG. 10 exemplifies the jth pixel (DPj) as a repaired pixel, and each of the repaired pixels may be embodied substantially the same as the jth display pixel (DPj).

Additionally, because anode electrodes of the organic light emitting diodes (OLED) of the display pixels are overlapped, parasitic capacitances (PC) may be formed between the auxiliary line (RL) and the organic light emitting diodes (OLED) of the display pixels as in FIG. 10. Furthermore, because the auxiliary line (RL) is formed adjacent to and substantially in parallel to (e.g., in parallel to) the kth scan line (Sk), a fringe capacitance (FC) may be formed between the auxiliary line (RL) and the kth scan line (Sk). Because a potential of the auxiliary line (RL) may be changed by the coupling voltage generated by the fringe capacitance (FC), there may occur a problem of the organic light emitting diode (OLED) of the jth display pixel (DPj) emitting light erroneously. However, in order to resolve this, the embodiment of the present disclosure supplies a compensation current using the compensation pixel (CP1). As a result, in the embodiment of the present disclosure, the voltage of the auxiliary line (RL) may change due to the parasitic capacitances (PC) and the fringe capacitance (FC), thereby preventing or substantially preventing the organic light emitting diode (OLED) from emitting light erroneously.

Additionally, the pixel driver (110), the auxiliary pixel driver (210), and the compensation pixel driver (310) illustrated in FIG. 10 are only one embodiment of the present invention. Therefore, the pixel driver (110), auxiliary pixel driver (210), and the compensation pixel driver (310) are not limited to the embodiment illustrated in FIG. 10.

Figure 11:
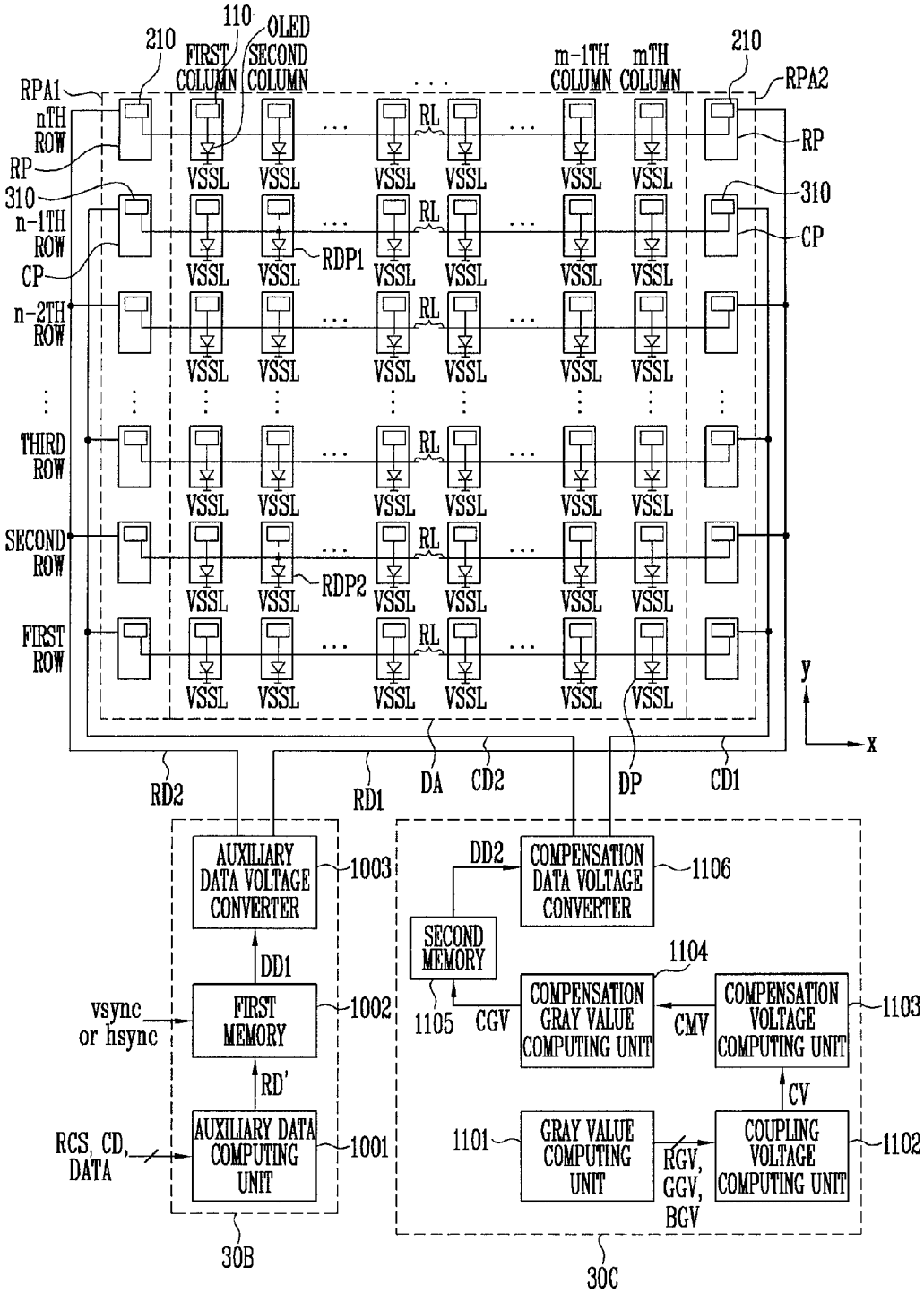
FIG. 11 is a block diagram illustrating display pixels, auxiliary pixels, compensation pixels, auxiliary lines, auxiliary data lines, compensation data lines, a second data driver, and a third data driver according to another embodiment of the present disclosure.

FIG. 11 is a block diagram illustrating display pixels, auxiliary pixels, compensation pixels, auxiliary lines, auxiliary data lines; compensation data lines, second data driver, and third data driver according to another embodiment of the present disclosure. FIG. 11 illustrates only the display pixels (CP), auxiliary pixels (RP), compensation pixels (CP), auxiliary lines (RL), auxiliary data lines (RD1 and RD2), compensation data lines (CD1 and CD2), second data driver (30B), and third data driver (30B) for convenience of explanation.

Referring to FIG. 11, each of the display pixels (DP) includes a display pixel driver (110) and an organic light emitting diode (OLED). The organic light emitting diode (OLED) emits light in a brightness (e.g., a predetermined brightness) according to the driving current of the display pixel driver (110). The anode electrode of the organic light emitting diode (OLED) may be connected to the display pixel driver (110), and the cathode electrode may be connected to a fourth power voltage line (VSSL) where the fourth power voltage is supplied. The fourth power voltage may be a low potential power voltage.

Each of the auxiliary pixels (RP) includes an auxiliary pixel driver (210). The auxiliary pixel driver (210) is connected to the auxiliary line (RL). The auxiliary pixel driver (210) supplies the driving current to the auxiliary line (RL). Each of the compensation pixels (CP) includes a compensation pixel driver (310). The compensation pixel driver (310) is connected to the auxiliary line (RL). The compensation pixel driver (310) supplies the compensation current to the auxiliary line (RL). The display pixel driver (110), the auxiliary pixel driver (210), and the compensation pixel driver (310) are explained hereinabove with reference to FIG. 10.

The auxiliary pixels and compensation pixels are arranged alternately in turns in a data line direction (e.g., the extension direction of the data line). As in FIG. 11, the auxiliary pixels (RP) may be arranged on even lines, and the compensation pixels (CP) may be arranged on odd lines. In this case, the auxiliary pixels (RP) may be connected to even scan lines, and the compensation pixels (CP) may be connected to odd scan lines. As in FIG. 11, in the case where the auxiliary pixels and compensation pixels are arranged alternately in turns in a data line direction, there is an effect of reducing the size of the nondisplay area of the display panel.

The auxiliary line (RL) is connected to the auxiliary pixel (RP) and the compensation pixel (CP), and is extended from the auxiliary pixel (RP) or the compensation pixel (CP) to the display area (DA) and cross the display pixels (DP). For example, as in FIG. 11, the auxiliary line (RL) may be connected to the auxiliary pixel (RP) of the pth line, cross the display pixels (DP) of the pth line, or be connected to the compensation pixel (CP) of the (p+1)th line and to cross the display pixels of the (p+1)th line. For example, as in FIG. 11, the auxiliary line (RL) may be formed to cross the anode electrodes of the organic light emitting diodes (OLEDs) of the display pixels (DP).

The auxiliary line (RL) may be connected to one of the display pixels (DP) of the display area (DA). Herein, the display pixel (DP) being connected to the auxiliary line (RL) is a defective pixel that must be repaired. In FIG. 11, the display pixel (DP) being connected to the auxiliary line (RL) is defined as the repaired pixel (RDP1/RDP2). For example, the auxiliary line (RL) may be connected to the anode electrode of the organic light emitting diode (OLED) of the repaired pixel (RDP1/RDP2). Herein, the display pixel driver (110) of the repaired pixel (RDP1/RDP2) and the organic light emitting diode (OLED) are disconnected.

The auxiliary line (RL) is disconnected between the auxiliary pixel (RP) or the compensation pixel (CP) and the display pixels (DP) of the first row or mth row. However, the auxiliary line (RL) connected to the repaired pixels (RDP1/RDP2) is not disconnected between the auxiliary pixel (RP) or compensation pixel (CP) and the display pixels (DP) of the first row or mth row as in FIG. 11. Furthermore, as in FIG. 11, the auxiliary line of the odd line and the auxiliary line of the even line are connected to each other in the first and second auxiliary pixel area (RP1, RP2).

The auxiliary pixels (RP) of the first auxiliary pixel area (RP1) are connected to the first auxiliary data line (RD1), and the compensation pixels (CP) are connected to the first compensation data line (CD1). The auxiliary pixels (RP) of the second auxiliary pixel area (RP2) are connected to the second auxiliary data line (RD2) and the compensation pixels (CP) are connected to the first compensation data line (CD2). The display pixels (DP) of the display area (DA) are connected to the data lines (D1~Dm), but in FIG. 11, the data lines (D1~Dm) are omitted for convenience of explanation.

The second data driver (30B) includes an auxiliary data computing unit (1001), a first memory (1002), and an auxiliary data voltage converter (1003). The second data driver (30B) is explained hereinabove with reference to FIGS. 2 and 4, and thus further explanation may not be provided.

The third data driver (30C) includes a gray value computing unit (1101), a coupling voltage computing unit (1102), a compensation voltage computing unit (1103), a compensation data computing unit (1104), a second memory (1105), and a compensation data voltage converter (1106). The third data driver (30C) is explained hereinabove with reference to FIGS. 2 and 5 to 9 and thus further explanation may not be provided.

FIG. 12 is an exemplary timing diagram illustrating data voltages being output from a first data driver of FIG. 11, auxiliary data voltages being output from a second data driver, and auxiliary data voltages being output from a third data driver. FIG. 12 illustrates a horizontal sync signal (hsync), data voltages (DVi) being output to an ith data line (Di, i being a positive integer satisfying $1 \leq i \leq m$), auxiliary data voltages (RDV) being output to the first or second auxiliary data line (RD1/RD2), and compensation data voltages (CDV) being output to first or second compensation data lines (CD1/CD2).

Referring to FIG. 12, 1 frame period includes an active period (AP) where data voltages are supplied to display pixels (DP) and a blank period (BP), which is a pausing period. A horizontal sync signal (hsync) generates a pulse at every 1 horizontal period (1H). The data voltages (Dvi) being output to the ith data line (Di) may include first to nth data voltages (DV1~DVn).

Herein, as in FIG. 11, the auxiliary pixels (RP) may be arranged on even lines, compensation pixels (CP) may be arranged on odd lines, and accordingly, the auxiliary pixels (RP) may be connected to even scan lines, and the compensation pixels (CP) may be connected to odd scan lines.

In an example, the auxiliary pixel (CP) is connected to the kth scan line, and the auxiliary pixel (RP) is connected to the (k+1)th scan line and to the compensation pixel (CP) connected to the kth scan line. A compensation data voltage is supplied that is synchronized with the data voltages being supplied to the display pixels connected to the kth scan line, and to the auxiliary pixel (RP) connected to the (k+1)th scan line. Further, an auxiliary data voltage is supplied that is synchronized with the data voltages being supplied to the display pixels connected to the (k+1)th scan line.

As in FIG. 12, when the first repaired pixel (RDP1) is arranged on the second line, the auxiliary line (RL) connected to the first repaired pixel (RDP1) is connected to the compensation pixel (CP) of the first line and the auxiliary pixel (RP) of the second line. Because the compensation pixel (CP) of the first line is connected to the first scan line, to the compensation pixel (CP) of the first line, a second compensation data voltage (CDV2) is supplied in synchronization with the data voltage (DV1) being supplied to the display pixels of the first line connected to the first scan line. Furthermore, because the auxiliary pixel (RP) of the second line is connected to the second scan line, to the auxiliary pixel (RP) of the second line, a second auxiliary data voltage (RDV2) is supplied in synchronization with the data voltage (DV2) being supplied to the display pixels of the second line connected to the second scan line.

Furthermore, as in FIG. 12, when the second repaired pixel (RDP2) is arranged on the (n−1)th line, the auxiliary line (RL) connected to the second repaired pixel (RDP2) is connected to the compensation pixel (CP) of the (n−1)th line and the auxiliary pixel (RP) of the nth line. Because the compensation pixel (CP) of the n−1th line is connected to the (n−1)th scan line, to the compensation pixel (CP) of the (n−1)th line, (n−1)th compensation data voltages (CDVn−1) are supplied in synchronization with the data voltage (DVn−1) being supplied to the display pixels of the (n−1)th line connected to the (n−1)th scan line. Furthermore, because the auxiliary pixel (RP) of the nth line is connected to the nth scan line, to the auxiliary pixel (RP) of the nth line, (n−1)th auxiliary data voltages (RDVn−1) are supplied in synchronization with the data voltages (DVn) being supplied to the display pixels of nth line connected to the nth scan line.

As aforementioned, the embodiment of the present disclosure arranges auxiliary pixels (RP) on even lines, and arranges compensation pixels (CP) on odd lines. Therefore, the embodiment of the present disclosure controls the timing of supplying auxiliary data voltage being supplied to auxiliary pixels (RP) and the compensation data voltage being supplied to the compensation pixels (CP) according to whether the repaired pixel (RDP1/RDP2) is arranged on an odd line or an even line.

Figure 13:
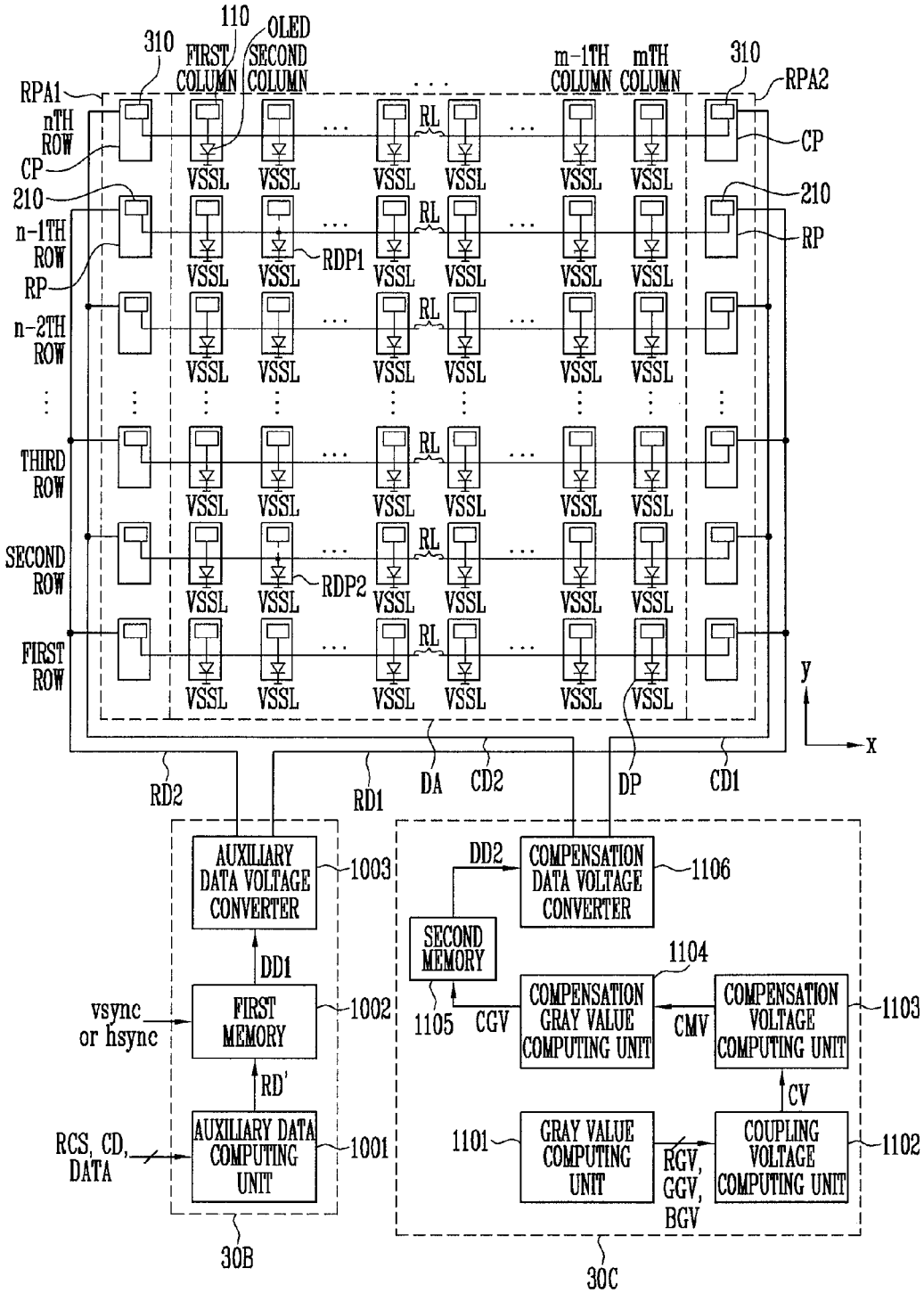
FIG. 13 is a block diagram illustrating display pixels, auxiliary pixels, compensation pixels, auxiliary data lines, compensation data lines, a second data driver, and a third data driver according to another embodiment of the present disclosure.

FIG. 13 is a block diagram illustrating display pixels, auxiliary pixels, compensation pixels, auxiliary data lines, compensation data lines, second data driver, and third data driver according to another embodiment of the present disclosure. FIG. 13 illustrates only display pixels, auxiliary pixels, compensation pixels, auxiliary data lines, compensation data lines, second data driver, and third data driver for convenience of explanation.

Referring to FIG. 13, each of the display pixels (DP) includes a display pixel driver (110) and an organic light emitting diode (OLED). The organic light emitting diode (OLED) emits light in a brightness (e.g., a predetermined brightness) according to the driving current of the display pixel driver (110). An anode electrode of the organic light emitting diode (OLED) may be connected to the display pixel driver (110), and a cathode electrode may be connected to a fourth power voltage line (VSSL) where a fourth power voltage is connected. The fourth power voltage may be a low potential power voltage.

Each of the auxiliary pixels (RP) includes an auxiliary pixel driver (210). The auxiliary pixel driver (210) is connected to the auxiliary line (RL). The auxiliary pixel driver (210) supplies the driving current to the auxiliary line (RL). Each of the compensation pixels (CP) includes a compensation pixel driver (310). The compensation pixel driver (310) is connected to the auxiliary line (RL). The compensation pixel drive (310) supplies a compensation current to the auxiliary line (RL). The display pixel driver (110), the compensation pixel driver (210), and the compensation pixel driver (310) were explained hereinabove with reference to FIG. 10, and a detailed explanation thereof may not be provided.

The auxiliary pixels and the compensation pixels are arranged alternately in turns in a data line direction (e.g., the extension direction of the data line). As in FIG. 13, the auxiliary pixels (RP) may be arranged on odd lines, and the compensation pixels (CP) may be arranged on even scan lines. As in FIG. 13, in the case where the auxiliary pixels and the compensation pixels are arranged alternately in turns in the data line direction, there is an effect of reducing the size of the nondisplay area.

The auxiliary line (RL) is connected to the auxiliary pixel (RP) and the compensation pixel (CP) and is extended to the display area (DA) from the auxiliary pixel (RP) or the compensation pixel (CP) to cross (e.g., to intersect) the display pixels (DP). For example, as illustrated in FIG. 13, the auxiliary line (RL) may be connected to the auxiliary pixel (RP) of the pth line and cross the display pixels (DP) of the pth line, or be connected to the compensation pixel (CP) of the (p+1)th line and cross the display pixels (DP) of the (p+1)th line. For example, as in FIG. 13, the auxiliary line (RL) may cross the anode electrodes of the organic light emitting diode (OLED) of the display pixels (DP).

The auxiliary line (RL) may be connected to one of the display pixels (DP) of the display area (DA). Herein, the display pixel (DP) being connected to the auxiliary line (RL) is a defective pixel that must be repaired. In FIG. 13, the display pixel (DP) that is connected to the auxiliary line (RL) is defined as the repaired pixel (RDP1/RDP2). For example, the auxiliary line (RL) may be connected to the anode electrode of the organic light emitting diode (OLED) of the repaired pixel (RDP1/RDP2). Herein, the display pixel driver (110) of the repaired pixel (RDP1/RDP2) and the organic light emitting diode (OLED) are disconnected.

The auxiliary line (RL) is disconnected between the auxiliary pixel (RP) or compensation pixel (CP) and display pixels (DP) of the first row to mth row as illustrated in FIG. 13. However, the auxiliary line (RL) connected to the repaired pixel (RDP1/RDP2) is not disconnected between the auxiliary pixel (RP) or the compensation pixel (CP) and the display pixels (DP) of the first row to mth row. Furthermore, as shown in FIG. 13, the auxiliary line of the odd line and the auxiliary line of the even line are connected to each other in the first and second auxiliary pixel areas (RPI and RP2).

The auxiliary pixels (RP) of the first auxiliary pixel area (RPI) are connected to the first auxiliary data line (RD1) and the compensation pixels (CP) are connected to the first compensation data line (CD1). The auxiliary pixels (RP) of the second auxiliary pixel area (RP2) are connected to the second auxiliary data line (RD2), and the compensation pixels (CP) are connected to the first compensation data line (CD2). The display pixels (DP) of the display area (DA) are connected to the data lines (D1~Dm), but the data lines (D1~Dm) are omitted from FIG. 13 for convenience of explanation.

The second, data driver (30B) includes an auxiliary data computing unit (1001), a first memory (1002) and an auxiliary data voltage converter (1003). The second data driver (30B) is explained in more detail hereinabove with reference to FIGS. 2 and 4.

The third data driver (30C) includes a gray computing unit (1101), a coupling voltage computing unit (1102), a compensation voltage computing unit (1103), a compensation data computing unit (1104), a second memory (1105), and a compensation data voltage converter (1106). The third data driver (30C) is explained in more detail hereinabove with reference to FIGS. 2 and 5 to 9.

Figure 14:
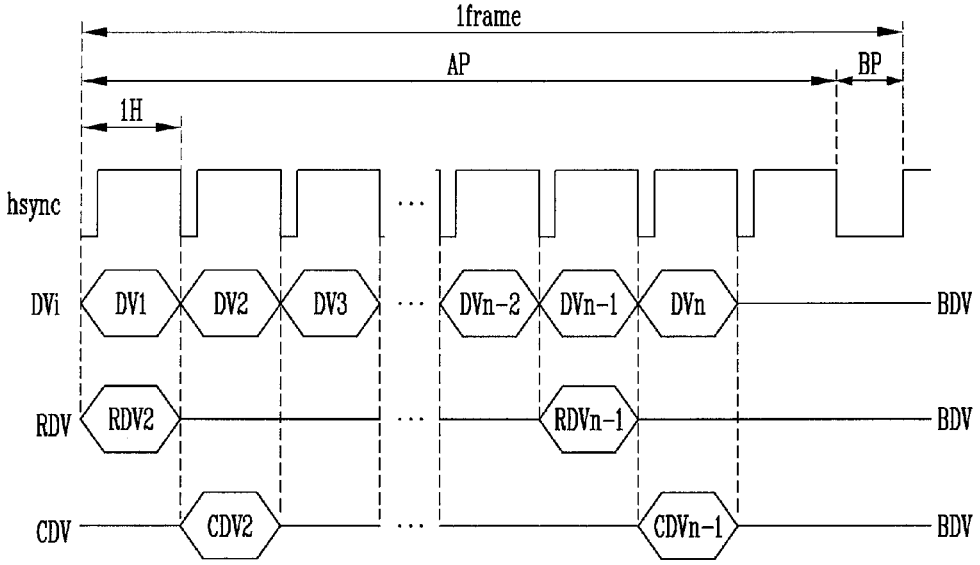
FIG. 14 is an exemplary timing diagram illustrating data voltages being output from a first data driver of FIG. 13, auxiliary data voltages being output from a second data driver, and compensation data voltages being output from a third data driver.

FIG. 14 is an exemplary timing diagram illustrating data voltages being output from a first data driver of FIG. 13, auxiliary data voltages being output from a second data driver, and compensation data voltages being output from a third data driver. FIG. 14 illustrates a horizontal sync signal (hsync), data voltages (DVi) being output to an ith data line (Di, i being a positive integer satisfying $1 \leq i \leq m$), auxiliary data voltages (RDV) being output to a first or second auxiliary data line (RD1/RD2), and compensation data voltages (CDV) being output to a first or second compensation data line (CD1/CD2).

Referring to FIG. 14, 1 frame period includes an active period (AP) where data voltages are supplied to display pixels (DP) and a blank period (BP), which is a pausing period. In the horizontal sync signal (hsync), a pulse occurs every 1 horizontal period (1H). The data voltages (DVi) being output to the ith data line (Di) may include a first to nth data voltages (DV1~DVn).

Herein, as illustrated in FIG. 13, the auxiliary pixels (RP) are arranged on odd lines, and the compensation pixels (CP) are arranged and even lines, and accordingly, the auxiliary pixels (RP) may be connected to odd scan lines, and the compensation pixels (CP) may be connected to even scan lines.

Assuming that the auxiliary pixel (RP) is connected to the kth scan line, and the compensation pixel (CP) is connected to the (k+1)th scan line, to the auxiliary pixel (RP) connected to the kth scan line, an auxiliary data voltage is supplied that is synchronized with the data voltages being supplied to the display pixels connected to the kth scan line, and to the compensation pixel (CP) connected to the (k+1)th scan line, a compensation data voltage is supplied in synchronization with the data voltages being supplied to the display pixels connected to the (k+1)th scan line.

As in FIG. 14, when the first repaired pixel (RDP1) is arranged on the second line, the auxiliary line (RL) connected to the first repaired pixel (RDP1) is connected to the auxiliary pixel (RP) of the first line and the compensation pixel (CP) of the second line. Because the auxiliary pixel (RP) of the first line is to the first scan line, to the auxiliary pixel (RP) of the first line, a second compensation data voltage (RDV2) is supplied in synchronization with the data voltage (DV1) being supplied to the display pixels of the first line connected to the first scan line. Furthermore, because the compensation pixel (CP) of the second line is connected to the second scan line, to the compensation pixel (CP) of the second line, a second compensation data voltage (CDV2) is supplied in synchronization with the data voltage (DV2) being supplied to the display pixels of the second line connected to the second scan line.

Furthermore, as in FIG. 14, when the second repaired pixel (RDP2) is arranged on the (n−1)th line, the auxiliary line (RL) connected to the second repaired pixel (RDP2) is connected to the auxiliary pixel (RP) of the (n−1)th line and the compensation pixel (CP) of the nth line. Because the auxiliary pixel (RP) of the (n−1)th line is connected to the (n−1)th scan line, to the auxiliary pixel (RP) of the (n−1)th line, (n−1)th auxiliary data voltages (RDVn−1) are supplied in synchronization with the data voltage (DVn−1) being supplied to the display pixels of the n-lth line connected to the (n−1)th scan line. Furthermore, because the compensation pixel (CP) of the nth line is connected to the nth scan line, to the compensation pixel (CP) of the nth line, (n−1)th compensation data voltages (CDVn−1) are supplied in synchronization with the data voltages (DVn) being supplied to the display pixels of the nth line connected to the nth scan line.

As aforementioned, the embodiment of the present disclosure arranges compensation pixels (CP) on even lines, and arranges auxiliary pixels (RP) on odd lines. Therefore, the embodiment of the present disclosure controls the timing of supplying auxiliary data voltage being supplied to auxiliary pixels (RP) and the compensation data voltage being supplied to the compensation pixels (CP) according to whether the repaired pixel (RDP1/RDP2) is arranged on an odd line or an even line.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. An organic light emitting display device comprising:

data lines, an auxiliary data line, and a compensation data line;

a display area comprising display pixels connected to the data lines;

a nondisplay area comprising auxiliary pixels connected to the auxiliary data line and compensation pixels connected to the compensation data line, wherein the auxiliary pixels each comprising switching circuitry as in each display pixel; and auxiliary lines interconnecting the display pixels, auxiliary pixels and the compensation pixels, the auxiliary pixels being configured to repair one or more defective display pixels by disconnection of switching circuitry of the one or more defective display pixels and connection of switching circuitry of one or more auxiliary pixels as backup, and the compensation pixels being configured to compensate for changes of potentials of the auxiliary lines resulting from coupling voltage generated by parasitic capacitances formed between the auxiliary lines and the display pixels;

wherein an auxiliary data voltage and a compensated data voltage are generated using a repair control signal, digital video data, and coordinate data of a repaired display pixel, for supplying to the auxiliary data line and the compensation data line, respectively.

2. The organic light emitting display device according to claim 1, further comprising:

scan lines and light emitting control lines that cross the data lines, the auxiliary data line, and the compensation data line;

a data driver configured to supply data voltages to the data lines, to supply auxiliary data voltages to the auxiliary data line, and to supply compensation data voltages to the compensation data line; and a scan driver configured to supply scan signals to the scan lines, and to supply light emitting control signals to the light emitting control lines.

3. The organic light emitting display device according to claim 2, wherein an auxiliary pixel and a compensation pixel adjacent to each other in a scan line direction are connected to a same scan line and light emitting control line.

4. The organic light emitting display device according to claim 3, wherein the data driver is configured to synchronize an auxiliary data voltage and a compensation data voltage supplied to the auxiliary pixel and the compensation pixel adjacent to each other, and to supply the synchronized auxiliary data voltage and the compensation data voltage.

5. The organic light emitting display device according to claim 2, wherein the auxiliary pixels and the compensation pixels are arranged alternately by turns in a data line direction.

6. The organic light emitting display device according to claim 5, wherein the auxiliary pixels are connected to even scan lines, and the compensation pixels are connected to odd scan lines.

7. The organic light emitting display device according to claim 6, wherein the data driver is configured to supply a compensation data voltage to the compensation pixel connected to a kth scan line (k being a positive integer) in synchronization with data voltages supplied to the display pixels connected to the kth scan line, and to supply an auxiliary data voltage to the auxiliary pixel connected to a (k+1)th scan line in synchronization with data voltages supplied to the display pixels connected to the (k+1)th scan line.

8. The organic light emitting display device according to claim 5, wherein the auxiliary pixels are connected to odd scan lines, and the compensation pixels are connected to even scan lines.

9. The organic light emitting display device according to claim 8, wherein the data driver is configured to supply an auxiliary data voltage to the auxiliary pixel connected to a kth scan line (k being a positive integer) in synchronization with data voltages supplied to the display pixels connected to the kth scan line, and to supply a compensation data voltage to the compensation pixel connected to a (k+1)th scan line in synchronization with data voltages supplied to the display pixels connected to the (k+1)th scan line.

10. An organic light emitting display device comprising:

data lines, an auxiliary data line, and a compensation data line;

a display area comprising display pixels connected to the data lines;

a nondisplay area comprising auxiliary pixels connected to the auxiliary data line, and compensation pixels connected to the compensation data line, wherein the auxiliary pixels each comprising switching circuitry as in each display pixel;

auxiliary lines interconnecting the display pixels, auxiliary pixels and the compensation pixels, the auxiliary pixels being configured to repair one or more defective display pixels by disconnection of switching circuitry of the one or more defective display pixels and connection of switching circuitry of one or more auxiliary pixels as backup, and the compensation pixels being configured to compensate for changes of potentials of the auxiliary lines resulting from coupling voltage generated by parasitic capacitances formed between the auxiliary lines and the display pixels; and a data driver comprising:

an auxiliary data computing unit configured to compute digital video data being supplied to a repaired pixel of the display pixels as auxiliary data;

a memory configured to store the auxiliary data, and to update the auxiliary data to initialized data at every period; and an auxiliary data voltage converter configured to receive the auxiliary data or initialized data from the memory, to convert the auxiliary data or initialized data into an auxiliary data voltage, and to supply the converted auxiliary data voltage to the auxiliary data line.

11. An organic light emitting display device comprising:

data lines, an auxiliary data line, and a compensation data line;

a display area comprising display pixels connected to the data lines;

a nondisplay area comprising auxiliary pixels connected to the auxiliary data line, and compensation pixels connected to the compensation data line wherein the auxiliary pixels each comprising switching circuitry as in each display pixel;

auxiliary lines connected to the auxiliary pixels and the compensation pixels interconnecting the display pixels, auxiliary pixels and the compensation pixels, the auxiliary pixels being configured to repair one or more defective display pixels by disconnection of switching circuitry of the one or more defective display pixels and connection of switching circuitry of one or more auxiliary pixels as backup, and the compensation pixels being configured to compensate for changes of potentials of the auxiliary lines resulting from coupling voltage generated by parasitic capacitances formed between the auxiliary lines and the display pixels; and a driver comprising:

a gray value computing unit configured to compute red gray values supplied to red pixels, green gray values supplied to green pixels, and blue gray values supplied to blue pixels, the red pixels, the green pixels, and the blue pixels connected to a same scan line as a repaired pixel of the display pixels;

a coupling voltage computing unit configured to compute a coupling voltage corresponding to a voltage at which the auxiliary line is affected by the red pixels, green pixels, and blue pixels connected to a same scan line as the repaired pixel using the red gray values, green gray values, and blue gray values;

a compensation voltage computing unit configured to compute a compensation voltage as a difference between a maximum coupling voltage and the coupling voltage; and a compensation data computing unit configured to compute compensation data according to the compensation voltage.

12. The organic light emitting display device according to claim 11, wherein the data driver further comprises a compensation data voltage converter configured to convert the compensation data into a compensation data voltage and to supply the converted compensation data voltage to the compensation data line.

13. The organic light emitting display device according to claim 11, wherein the coupling voltage computing unit is further configured to compute red coupling voltages corresponding to voltages at which the auxiliary lines are affected by the red pixels using the red gray values, to compute green coupling voltages corresponding to voltages at which the auxiliary lines are affected by the green pixels using the green gray values, to compute blue coupling voltages corresponding to voltages affected by the auxiliary lines by the blue pixels using the blue gray values, and to add up the red coupling voltages, the green coupling voltages, and the blue coupling voltages to compute the coupling voltage.

* * * * *